US011022074B2

(12) United States Patent
Xue et al.

(10) Patent No.: US 11,022,074 B2
(45) Date of Patent: Jun. 1, 2021

(54) THROTTLE AND CHOKE CONTROL LINKAGE MECHANISM OF DIAPHRAGM TYPE CARBURETOR

(71) Applicant: Meiying Xue, Hangzhou (CN)

(72) Inventors: Meiying Xue, Hangzhou (CN); Yongcheng Jia, Hangzhou (CN)

(73) Assignee: Meiying Xue, Hangzhou (CN)

( * ) Notice: Subject to any disclaimer, the term of this patent is extended or adjusted under 35 U.S.C. 154(b) by 179 days.

(21) Appl. No.: 16/522,670

(22) Filed: Jul. 26, 2019

(65) Prior Publication Data

US 2020/0032743 A1 Jan. 30, 2020

(30) Foreign Application Priority Data

Jul. 27, 2018 (CN) ..... 201821203633.2

(51) Int. Cl.

| | |
|---|---|
| ***F02M 1/02*** | (2006.01) |
| ***F02M 7/22*** | (2006.01) |
| ***F02M 7/18*** | (2006.01) |
| ***F02M 3/02*** | (2006.01) |
| *F02M 17/04* | (2006.01) |

(52) U.S. Cl.

CPC ..... *F02M 1/02* (2013.01); *F02M 3/02* (2013.01); *F02M 7/18* (2013.01); *F02M 7/22* (2013.01); *F02M 17/04* (2013.01)

(58) Field of Classification Search

CPC .. F02M 1/02; F02M 7/22; F02M 7/18; F02M 3/02; F02M 17/04

See application file for complete search history.

(56) References Cited

U.S. PATENT DOCUMENTS 6,202,989 B1 * 3/2001 Pattullo ..... F02M 1/02 123/179.18

* cited by examiner

*Primary Examiner* — Robert A Hopkins

(57) ABSTRACT

The present disclosure discloses a throttle and choke control linkage mechanism of carburetor including a choke shaft rotatably installed with a choke valve, a throttle shaft rotatably installed with a throttle, a choke handle fixed on the choke shaft and configured for rotating the choke valve from a fully opened position to a fully closed position, a throttle grip fixed on the throttle shaft and configured for rotating the throttle from an idling position to an opened position, and a fast idle handle rotatably around the choke shaft. The choke handle is further provided with a first surface which is able to link with the throttle grip. When the choke handle is linked with the throttle grip, the choke valve is at the fully closed position, and the throttle is opened with an angle larger than the idling position.

13 Claims, 36 Drawing Sheets

THROTTLE AND CHOKE CONTROL LINKAGE MECHANISM OF DIAPHRAGM TYPE CARBURETOR

CROSS-REFERENCE TO RELATED APPLICATIONS

This application claims all benefits accruing under 35 U.S.C. § 119 from China Patent Application No. 201821203633.2, filed on Jul. 27, 2018, in the China National Intellectual Property Administration, the content of which is hereby incorporated by reference.

TECHNICAL FIELD

The present disclosure relates to the field of carburetor, in particular, to a throttle and choke control linkage mechanism of carburetor.

BACKGROUND

The carburetor is a mechanical device that mixes a ratio of gasoline with air under the vacuum generated by operation of an engine. At present, there are many types of carburetors on the market, and their structures are different. The functions and principles of carburetors are basically the same, mainly based on controlling the mixture of air and fuel entering the engine, and the flow of the mixture is determined by the throttle. An opening angle of the throttle is determined by pulling a throttle trigger of the engine, resulting in controlling the amount of mixture entering the engine.

Referring to FIGS. 37 to 49, a throttle and choke control linkage mechanism of a carburetor of the prior art is provided. When a choke lever on an engine is pulled, a choke handle 13 will rotate counterclockwise. Since the choke handle 13 and a choke shaft 7 are connected to each other by a non-circular portion, the choke shaft 7 will rotate together with a choke valve 9 fixed on the choke shaft 7 by a screw 8. At the same time, a stopper 13-1 of the choke handle 13 will touch a portion 11-1 of a fast idle handle 11, in order to push the fast idle handle 11 to overcome the torsion of a torsional spring 10 and then rotate counterclockwise. Under the tension of the choke lever, when the choke valve 9 is closed to a certain position, the fast idle handle 11 contacts a portion 5-1 of a throttle grip 5, in order to push a throttle shaft 1 and a throttle 3 fixed on the throttle shaft 1 by another screw 2 to gradually open with gradual closing of the choke valve 9. The portion 5-1 will fall into a ratchet 11-2 to generate a coupling. In order to ensure the portion 5-1 of the throttle grip 5 can fall into the ratchet 11-2 of the fast idle handle 11, the choke valve 9 and a main body choke hole 14-1 must not be completely closed. It is also impossible to close in the operation: when there is no over-travel, the portion 5-1 of the throttle grip 5 cannot fall into the ratchet 11-2 of the fast idle handle (11). In order to make sure that the fast idle handle 11 and the throttle grip 5 are coupled, there must be the over-travel (as shown in FIG. 42). At this time, the choke valve 9 and the main body choke hole 14-1 on a main body 14 are affected by the torsional spring on the fast idle handle, the choke valve cannot be completely closed and sealed, that is, a gap is generated during the over-travel. Due to an accumulated tolerance of each element, the position of the choke valve 9 is inconsistent. As shown in FIGS. 42 to 44, when the choke valve is fully closed under an external force, the fast idle handle and the throttle grip are interlocked, and there is a gap between the idle handle and the throttle grip. As shown in FIGS. 45 to 47, when the external force is released, the choke shaft 7 will be pushed back under the torsion of the torsional spring, causing the choke valve to open a part, thereby affecting the starting performance of the engine. After a fast idle linkage, there will be gaps in different sizes between the choke valve and an air intake of the main body, and the choke valve cannot be completely closed, resulting in a difference in an air intake amount when the engine is started and the starting performance of the engine.

Referring to FIGS. 48 and 49, another throttle and choke control linkage mechanism of another carburetor in prior art is provided. The difference between the throttle and choke control linkage mechanism in FIGS. 48 and 49 and the throttle and choke control linkage mechanism in FIGS. 37 to 47 is that the fast idle handle has a bevel on an upper portion in FIG. 48. The choke lever (not shown) on the engine pulls the choke handle 13, and the connecting portion of the choke handle 13 and the choke shaft 7 is provided with a flat shape to drive the choke shaft 7 and the choke valve 9 fixed by a screw 8 to rotate together. At the same time, a stopper 13-1 is in contact with the portion 11-1 of the fast idle handle 11 on the choke handle 13 to push the fast idle handle 11 and overcome the torsion of the torsional spring 10. Under the tension of the choke lever, when the choke valve 9 is rotated to a certain position, the fast idle handle 11 contacts an arm 5-1 of the throttle grip 5 and pushes the throttle shaft 1 and the throttle 3 fixed by a screw 2 to gradually open with the gradual closing of the choke valve 9. When the arm 5-1 of the throttle grip 5 slides along a surface of 11-3 of the fast idle handle 11 to a bevel 11-2 of the fast idle handle 11, the arm 5-1 of the throttle grip 5 will contact the bevel 11-2 of the fast idle handle 11 and generate an initial coupling. The choke handle 13 is continually pulled. When the choke valve 9 and the main body 14 are completely closed, the arm 5-1 of the throttle grip 5 is located on the bevel 11-2 of the fast idle handle 11 and slides to a certain point (as shown in FIG. 32), and at this time, an opening angle of the throttle 3 depends on the position of the arm 5-1 of the throttle grip 5 sliding on the bevel 11-2 of the fast idle handle 11. An accumulated tolerance of each element will result in that the position of the arm (5-1) of the mass-produced throttle handle (5) on the bevel 11-2 of the fast idle handle (11) will be inconsistent, so the opening angle of the throttle 3 is relatively inconsistent. The fast idle handle 11 will rotate counterclockwise to drive the choke valve 9 closed under the action of the throttle grip 5. However, due to manufacturing errors, the position of the throttle 3 is uncertain, which will affect the starting performance of the engine. Due to the accumulated tolerance of each element, the opening angle of throttle has a large difference after the fast idle linkage, resulting in poor consistency of engine starting and large engine speed dispersion when starting after fast idling.

In prior art, there will be gaps of different sizes between a choke valve and a throttle of the main body, which cannot be completely closed, resulting in a difference in the amount of mixture entering the engine when starting the engine, the starting performance of the engine, and the opening angle of the throttle. Therefore, there are large differences in engine starting consistency and engine speed at the time of quick idling after starting.

SUMMARY

An embodiment of the present disclosure includes a throttle and choke control linkage mechanism for a carburetor including a choke shaft rotatably installed with a choke valve, a throttle shaft rotatably installed with a throttle, a choke handle fixed on the choke shaft and configured for rotating the choke valve from a fully opened position to a fully closed position or from the fully closed position to the fully opened position, a throttle grip fixed on the throttle shaft and configured for rotating the throttle from an idling position to an opened position, and a fast idle handle being able to rotate freely around the choke shaft, the fast idle handle further carrying a first end of a torsional spring, which has a second end connected with the choke shaft. When the choke handle is pulled, the choke valve is rotated from the fully opened position to the fully closed position. The fast idle handle is disposed on the choke shaft which is deflected by the torsional spring and rotatable along a first path. The throttle grip is rotatable along a second path which is coplanar and intersects with the first path. The fast idle handle is provided with a locking recess configured for locking the throttle grip. When the choke handle departs from the throttle grip, the throttle is at the idling position and the throttle grip is locked within the locking recess. The choke handle is further provided with a first surface which is able to link with the throttle grip. When the choke handle is linked with the throttle grip, the choke valve is at the fully closed position, and the throttle is opened with an angle larger than the idling position.

Furthermore, when the choke handle is linked with the throttle grip, the throttle grip is not locked by the locking recess, and there is a gap between the throttle grip and the fast idle handle.

Furthermore, the choke shaft and the throttle grip are linked with each other via the torsional spring.

Furthermore, at least one of the choke handle and the fast idle handle is provided with a convex portion, the fast idle handle is contacted with the choke handle under the torsional spring, when the choke handle is pulled, the choke valve is rotated from the fully opened position to the fully closed position, the fast idle handle and the choke handle will rotate, and the choke handle is finally linked with the throttle grip.

Furthermore, the fast idle handle is rotatably fixed on the choke shaft.

Furthermore, the fast idle handle comprises a first through hole with a cylindrical shape, the fast idle handle further has a first peak.

Furthermore, when the fast idle handle rotates until the first peak contacts a sixth edge of the throttle grip, the throttle is located at a maximum throttle angle, and a fifth edge of the throttle grip has not yet entered into the locking recess of the fast idle handle.

Furthermore, the choke shaft penetrates through the first through hole of the fast idle handle, and the fast idle handle freely rotate about the choke shaft.

Furthermore, a choke shaft sleeve is disposed on a bottom side of the fast idle handle and sleeved around the choke shaft.

Furthermore, the choke handle comprises a third surface. When the choke handle is rotated to enable the fast idle handle to rotate, the third surface touches a third peak of the throttle grip, a part of a fifth edge of the throttle grip contacts with a ninth edge of the fast idle handle and is not located in the locking recess.

Furthermore, the throttle grip is provided with a first linkage shaft configured for engaging the fast idle handle. When the fast idle handle rotates and the first peak contacts with the first linkage shaft, the throttle is rotated to a maximum throttle angle by the throttle grip.

Furthermore, the throttle grip is further provided with a second linkage shaft configured for engaging the choke handle. When the choke handle rotates until the second linkage shaft touch a first surface of the choke handle, the first linkage shaft contacts with a ninth edge of the fast idle handle, but not contact the locking recess.

Compared with the prior art, the choke handle is further provided with the first surface which is able to link with the throttle grip. When the choke handle is linked with the throttle grip, the choke valve is at the fully closed position, the throttle is opened with the angle larger than the idling position. Therefore, it is easier to start the engine.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as a skilled person in the art would understand. The terminology used in the description of the present disclosure is for the purpose of describing particular embodiments and is not intended to limit the disclosure.

Figure 1:
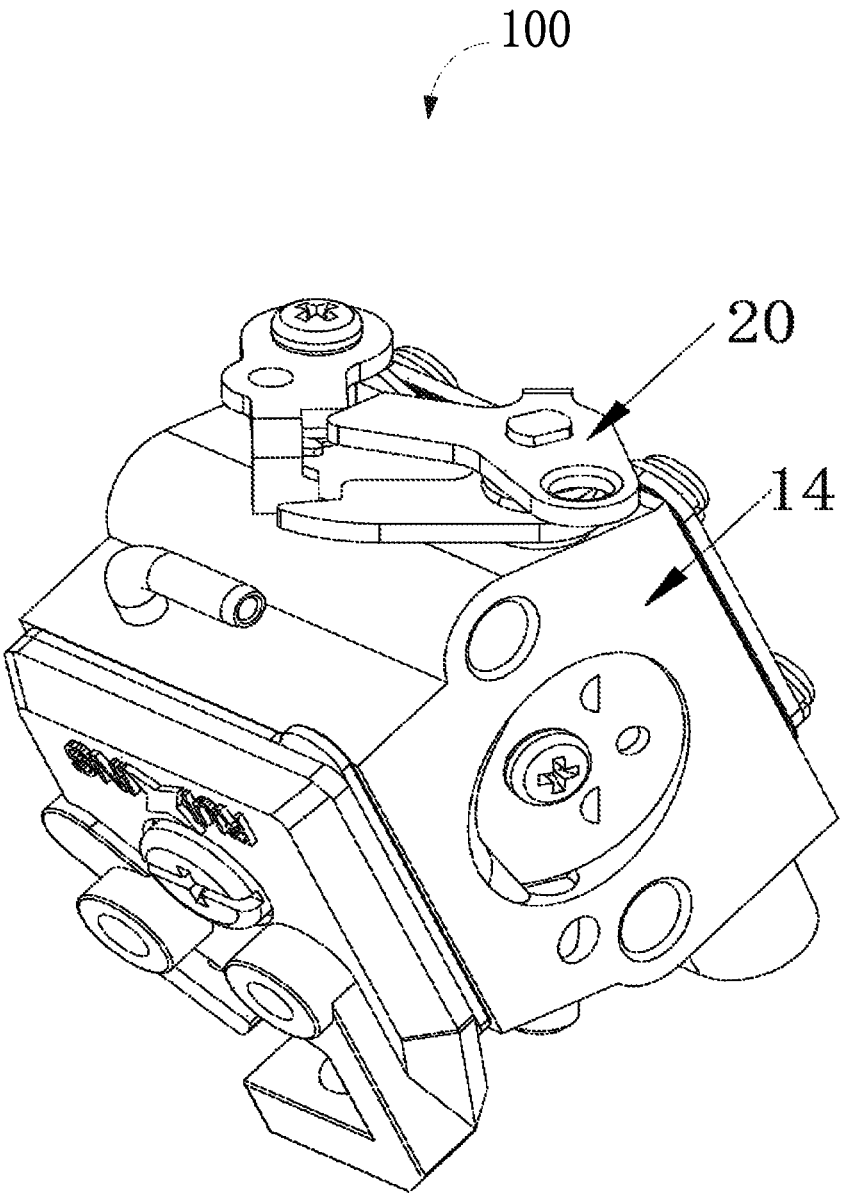
FIG. 1 is a perspective view of a throttle and choke control linkage mechanism in an embodiment of the present disclosure.

Referring to FIG. 1, an embodiment of the present disclosure includes a carburetor 100 100 including a main body 14 and a throttle and choke control linkage mechanism 20. The throttle and choke control linkage mechanism 20 is mounted on the main body 14.

The carburetor 100 can be a diaphragm type carburetor 100. The carburetor 100 can be other types.

In this embodiment, the carburetor 100 is the diaphragm type carburetor 100, the throttle and choke control linkage mechanism 20 is a throttle and choke control linkage mechanism of the diaphragm type carburetor 100. The structure and working process of the throttle and choke control linkage mechanism 20 will be represented hereinafter.

Figure 2:
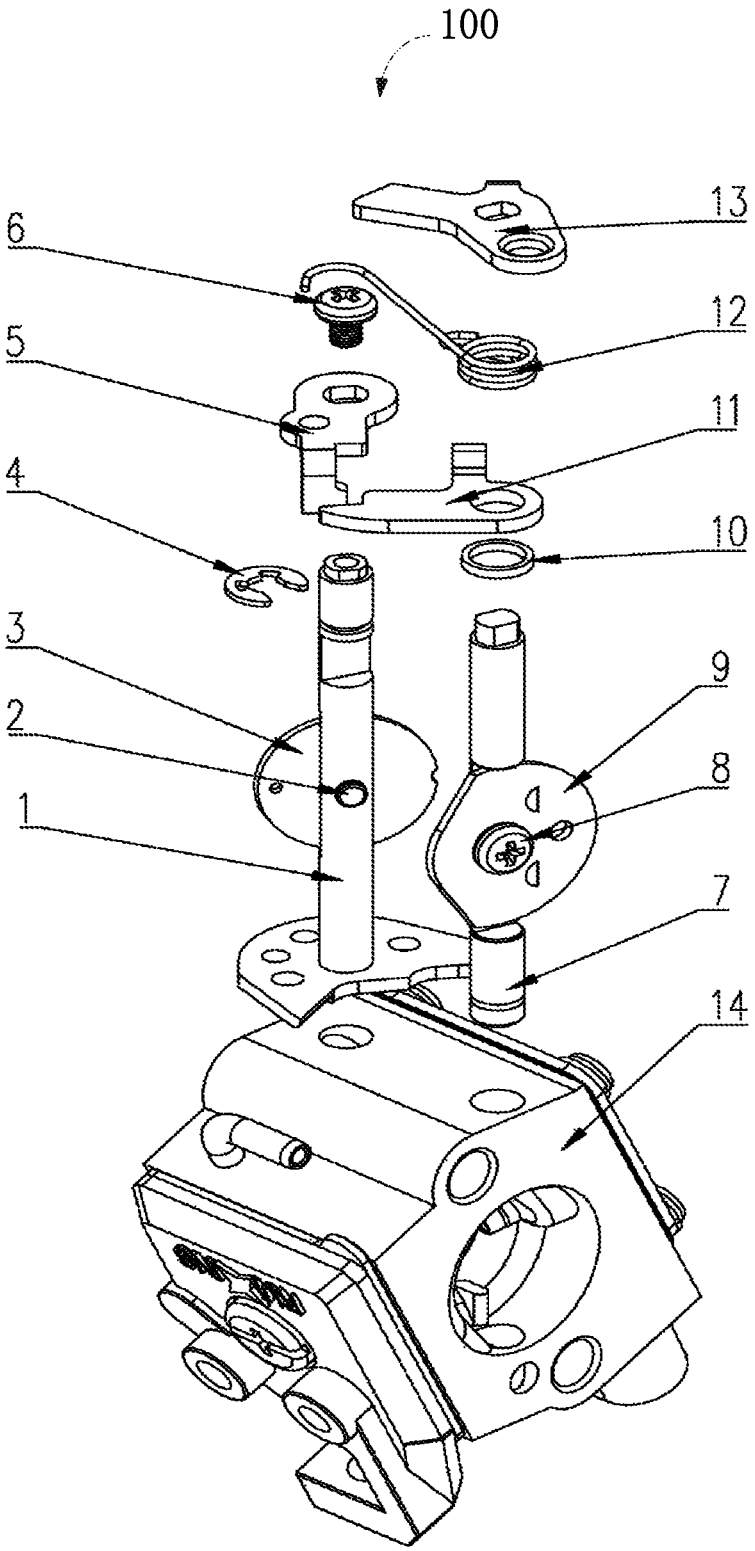
FIG. 2 is an exploded view of the throttle and choke control linkage mechanism in FIG. 1.
Figure 4:
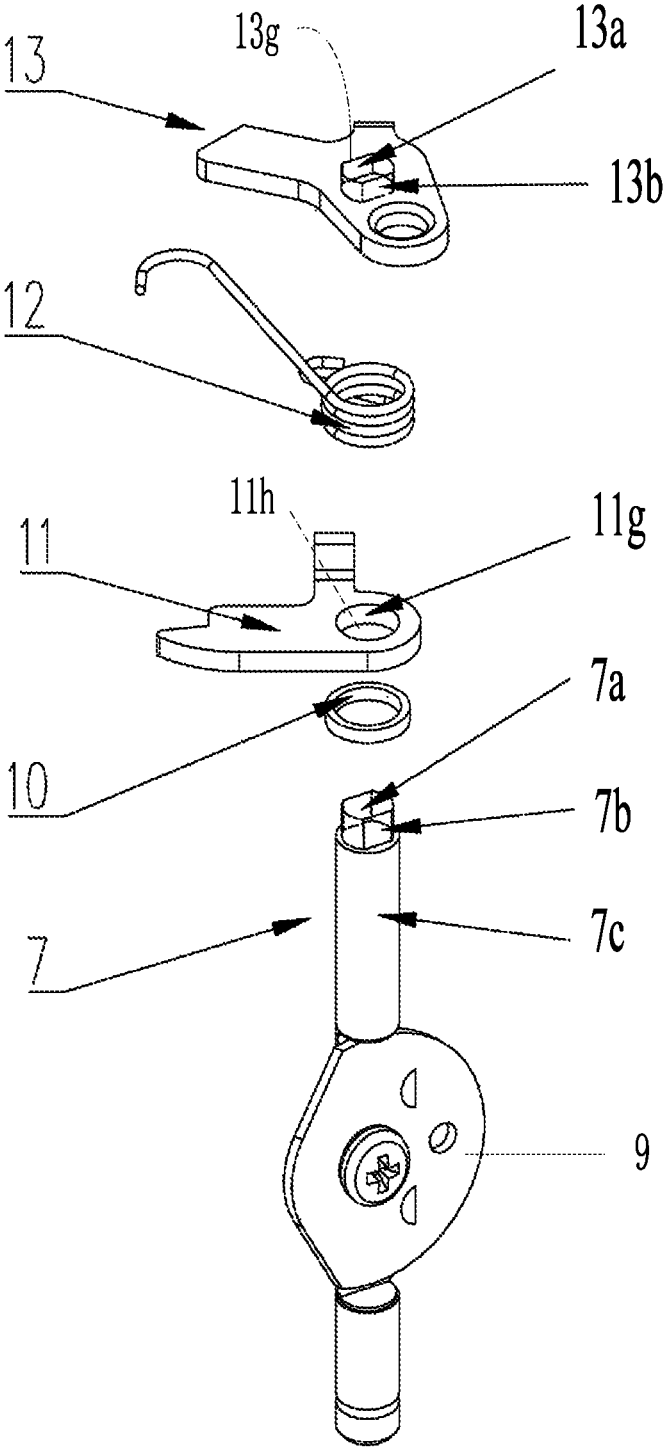
FIG. 4 is an exploded view of a choke shaft of the throttle and choke control linkage mechanism in FIG. 1.
Figure 5:
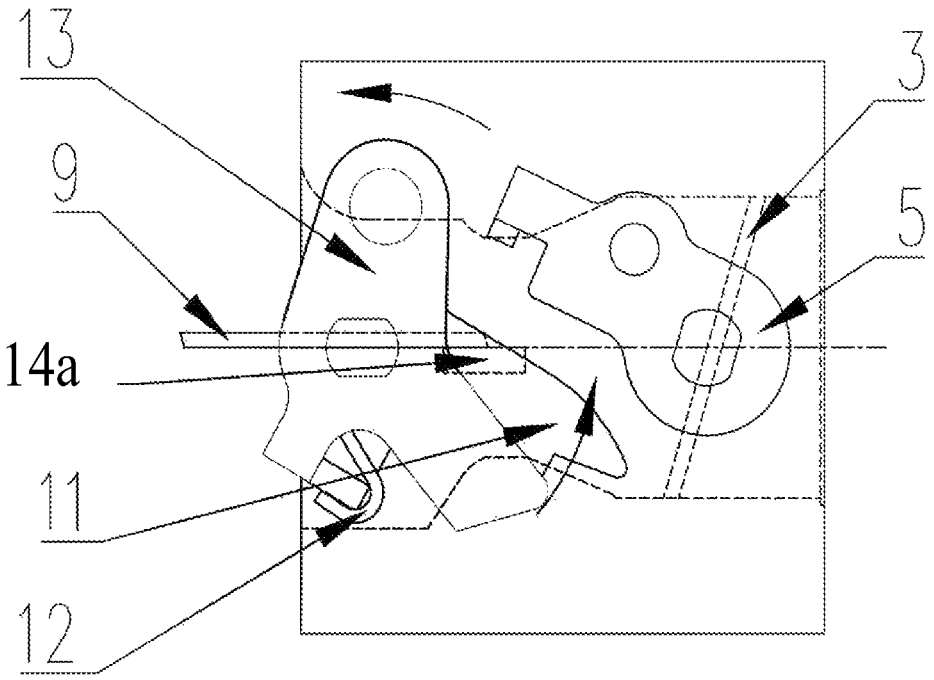
FIG. 5 is a perspective view of a choke valve at a fully opened position and a throttle at a fully closed position of the throttle and choke control linkage mechanism in FIG. 1.
Figure 6:
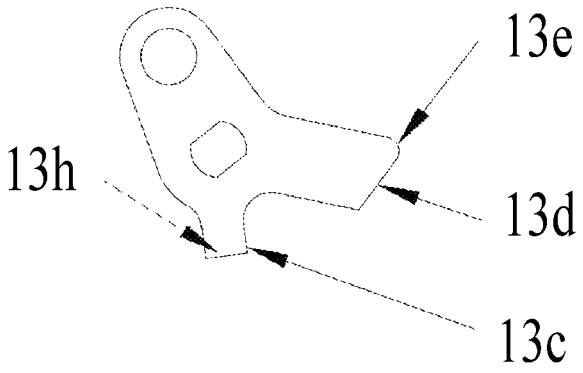
FIG. 6 is a perspective view of a choke handle of the throttle and choke control linkage mechanism in FIG. 1.

Referring to FIG. 2, the throttle and choke control linkage mechanism 20 can include a throttle shaft 1, a throttle 3, a throttle grip 5, a choke shaft 7, a choke valve 9, a fast idle handle 11 and a choke handle 13. The throttle and choke control linkage mechanism 20 is an integrated structure formed by the throttle 3, the choke valve 9, and a cold start and quick idle setting mechanism of a throttle-choke. Referring to FIG. 4, the choke shaft 7 can be installed with a choke handle 13, a torsional spring 12, a fast idle handle 11, and a choke shaft sleeve 10 and a choke valve 9 from top to bottom. The choke handle 13 is provided with a third through hole 13*g* configured for accommodating an end of the choke shaft 7. The choke handle 13 can be linked with the end of the choke shaft 7. An inner surface of the third through hole 13*g* can include a seventh non-circular surface 13*a* and an eighth non-circular surface 13*b* opposite to each other. When the choke valve 9 is fully closed, the throttle 3 is opened with an angle, the throttle grip 5 and the fast idle handle 11 are not in a linking state and there is a gap between the throttle grip 5 and the fast idle handle 11. The choke valve 9 can be fully closed and have a good consistency. When an engine is started and a "POP" sound is made, the choke valve 9 is opened, the choke handle 13 will detach from the throttle grip 5, and at the same time, the throttle grip 5 will be coupled with the fast idle handle 11, so a throttle angle can have a good consistency, greatly improving a starting performance and a fast idle speed of the engine.

When the choke valve 9 is rotated from an opened position to a fully closed position, the throttle 3 can automatically be opened to a position greater than a fast idling position, making the starting of the engine easier.

The choke shaft 7 is able to rotate and mount with the choke valve 9. The choke handle 13 is configured for rotating the choke valve 9 from a fully opened position to the fully closed position or from the fully closed position to the fully opened position, and fixed on the choke shaft 7. The throttle grip 5 can carry a torsional spring (not shown), be configured for rotating the throttle 3 from a fully closed position to a fully opened position and fixed on the throttle shaft 1. The fast idle handle 11 can carry a torsional spring 12 and be able to rotate freely around the choke shaft 7.

In an embodiment, referring to FIG. 4, the end of the choke shaft 7 includes a fifth non-circular surface 7*a* and a sixth non-circular surface 7*b* opposite to each other. The seventh non-circular surface 13*a* and the eighth non-circular surface 13*b* of the third through hole 13*g* of the choke handle 13 can be respectively coupled with the fifth non-circular surface 7*a* and the sixth non-circular surface 7*b*, so the choke handle 13 can drive the choke shaft 7 to rotate together.

Figure 3:
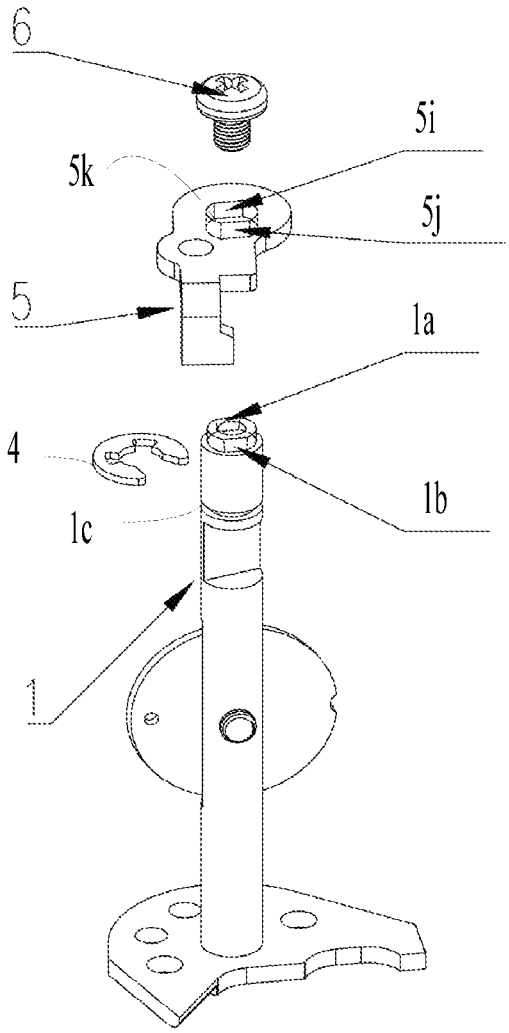
FIG. 3 is an exploded view of a throttle shaft of the throttle and choke control linkage mechanism in FIG. 1.

Referring to FIG. 3, the throttle grip 5 can include a second through hole 5*k*. The second through hole 5*k* includes a third non-circular surface 5*i* and a fourth non-circular surface 5*j* opposite to each other. An end of the throttle shaft 1 can include a first non-circular surface 1*a* and a second non-circular surface 1*b* opposite to each other. The first non-circular surface 1*a* and the second non-circular surface 1*b* are respectively coupled to the third non-circular surface 5*i* and the fourth non-circular surface 5*j* of the second through hole 5*k*. That is, the end of the throttle shaft 1 can be located within the second through hole 5*k* and is fastened to the throttle grip 5 by the upper screw 6.

The throttle shaft 1 can be provided with an annular groove 1*c*, and a shield ring 4 can be disposed in the annular groove 1*c*.

Referring to FIG. 4, the choke shaft 7 can include a fifth non-circular surface 7*a*, a sixth non-circular surface 7*b* and a cylindrical surface 7*c*.

Figure 7:
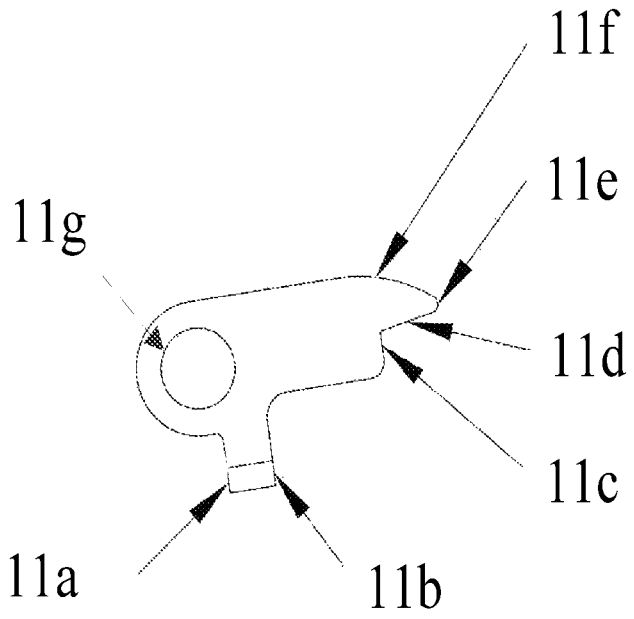
FIG. 7 is a perspective view of a fast idle handle of the throttle and choke control linkage mechanism in FIG. 1.
Figure 11:
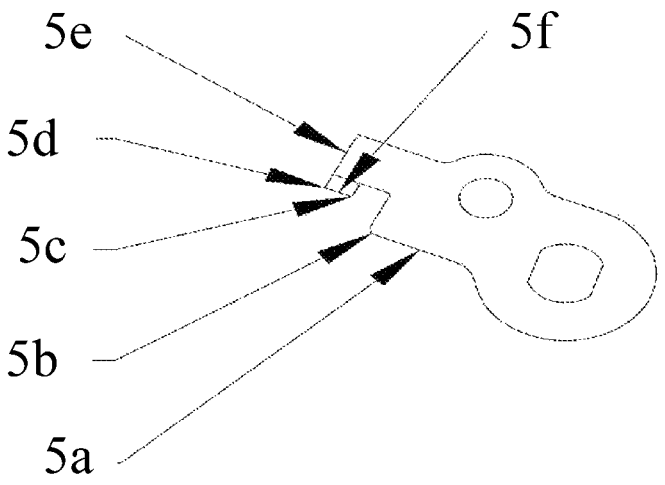
FIG. 11 is a perspective view of a throttle grip of the throttle and choke control linkage mechanism in FIG. 1.
Figure 12:
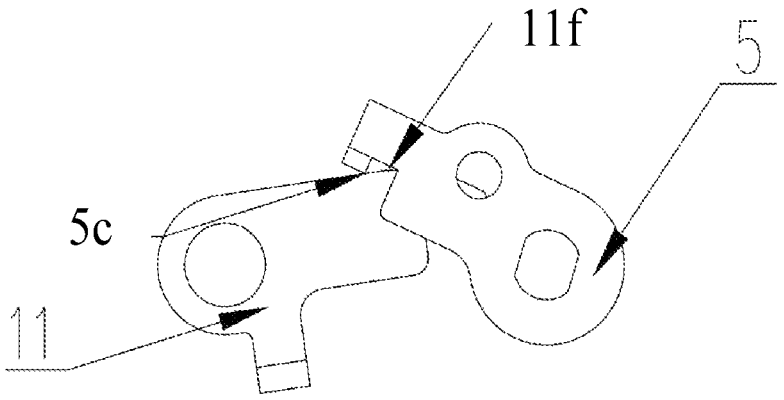
FIG. 12 is a perspective view of a fast idle handle and a throttle grip of the throttle and choke control linkage mechanism in FIG. 1, which are just in a contacting state.
Figure 13A:
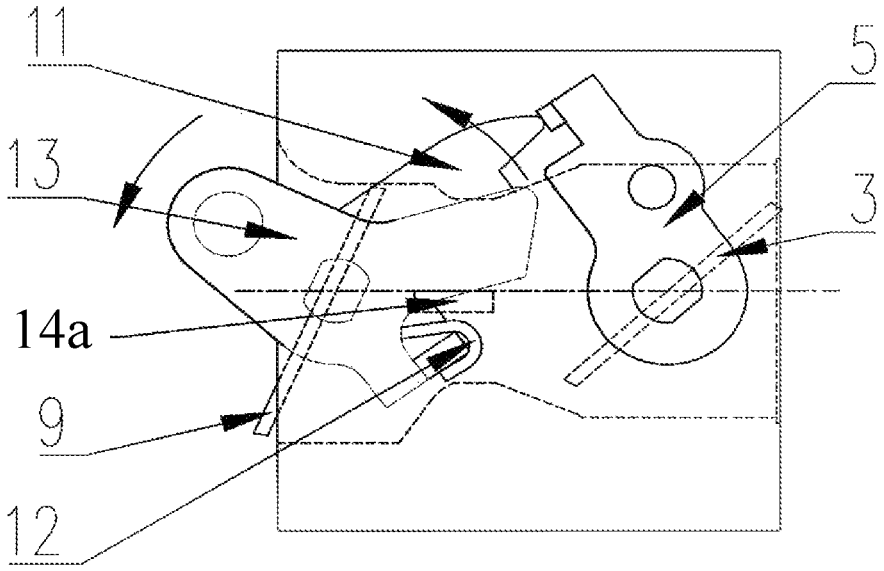
FIG. 13*a* is a perspective view of a throttle rotating to a maximum opening angle of the throttle and choke control linkage mechanism in FIG. 1.
Figure 13B:
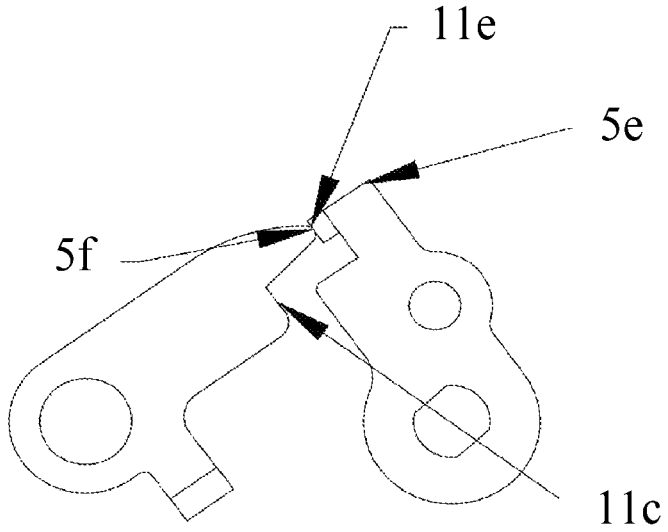
FIG. 13*b* is a perspective view of a fast idle handle and a throttle grip of the throttle and choke control linkage mechanism in FIG. 13*a*.

Referring to FIG. 4, the fast idle handle 11 can include a first through hole 11*h*. The first through hole 11*h* can have a cylindrical shape and include an inner surface 11*g*. Referring to FIG. 7, the fast idle handle 11 can further have a locking recess 11*c*, a ninth edge 11*d*, a first peak 11*e*, a tenth edge 11*f*, a seventh edge 11*a* and an eighth edge 11*b*. Referring to FIG. 11, FIG. 13*a* and FIG. 13*b*, when the fast idle handle 11 rotates until the first peak 11*e* contacts the sixth edge 5*f* of the throttle grip 5, the throttle 3 is located at a maximum throttle angle, and a fifth edge 5*e* of the throttle grip 5 has not yet entered into the locking recess 11*c* of the fast idle handle 11.

In the present embodiment, the choke shaft 7 penetrates through the first through hole 11*h* of the fast idle handle 11, and the cylindrical surface 7*c* can contact the inner surface 11*g* of the first through hole 11*h*. The fast idle handle 11 can freely rotate about the choke shaft 7.

Furthermore, a choke shaft sleeve 10 can be disposed on a bottom side of the fast idle handle 11 and sleeved around the choke shaft 7 (shown in FIG. 4).

Referring to FIG. 2, the fast idle handle 11 can be disposed on the choke shaft 7 which is deflected by the torsional spring 12. The fast idle handle 11 can rotate along a first path which is coplanar and intersects with a second path of rotating of the throttle grip 5.

At least one of the choke handle 13 and the fast idle handle 11 has a convex portion operatively connected with one of the choke handle 13 and the fast idle handle 11. The choke handle 13 rotates and makes the choke valve 9 close, causing the fast idle handle 11 to rotate toward an engaged position.

Figure 8:
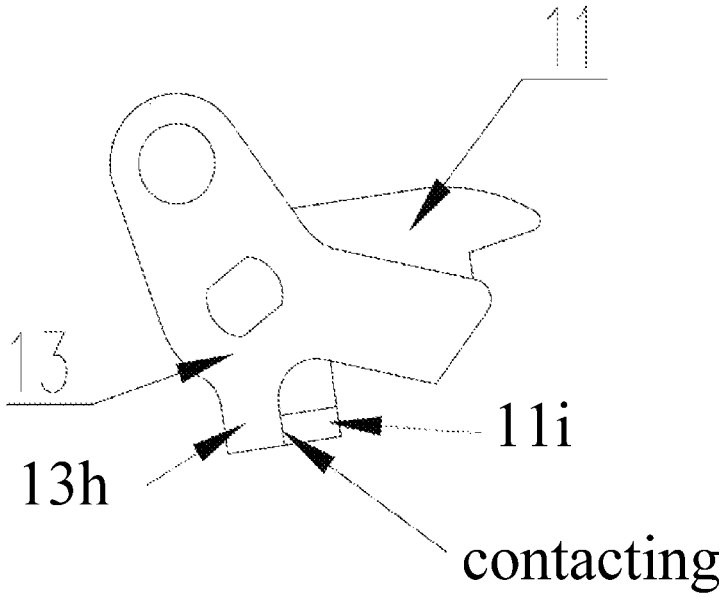
FIG. 8 is a perspective view of a choke handle and a fast idle handle of the throttle and choke control linkage mechanism in FIG. 1, which are in a contacting state.
Figure 9:
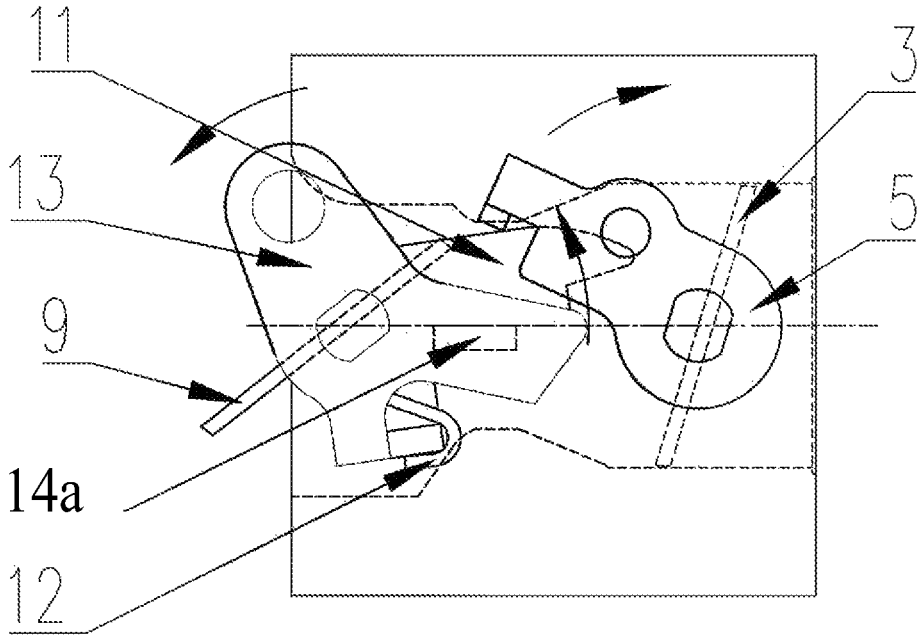
FIG. 9 is a perspective view of a choke valve at a closed position and a throttle at an opened position of the throttle and choke control linkage mechanism in FIG. 1.
Figure 10:
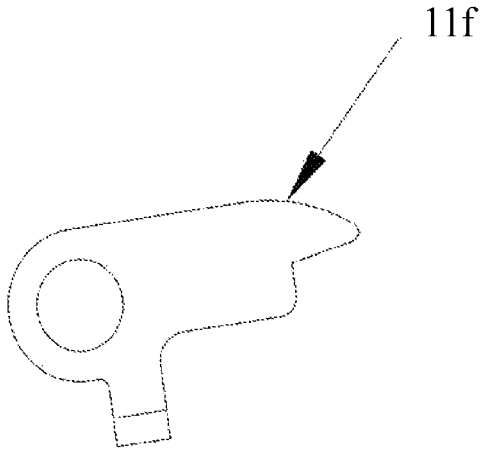
FIG. 10 is an enlarged view of a fast idle handle of the throttle and choke control linkage mechanism in FIG. 1.

Referring to FIG. 8, the choke handle 13 is provided with a first convex portion 13*h*, and the fast idle handle 11 is provided with a second convex portion 11*i*.

The choke valve 9 can rotate from the fully opened position to the fully closed position or from the fully closed position to the fully opened position by the rotating of the choke handle 13 and the choke shaft 7.

The throttle 3 can be fixed to the throttle shaft 1 by a bolt 2.

It can be shown that the choke valve 9 can rotate from the fully opened position to the fully closed position in FIG. 5-FIG. 8.

The choke handle 13 can include a plurality of surfaces. The plurality of surfaces of the choke handle 13 are configured for inter-connecting with the throttle grip 5. Referring to FIG. 8, when the choke valve 9 is at the fully opened position, the seventh edge 11*a* of the fast idle handle 11 contacts closely with a second surface 13*c* of the choke handle 13 under a torsion of the torsional spring 12. That is, there is no gap between the second convex portion 11*i* and the first convex portion 13*h*, which contacts with each other. When the choke valve 9 rotates from the fully opened position to the fully closed position, that is, the choke handle 13 is rotated counter-clockwise, the fast idle handle 11 is driven to rotate counter-clockwise by the choke handle 13.

It can be shown that the throttle 3 can rotate from an idling position to an opened position in FIG. 9-FIG. 12.

When the tenth edge 11*f* of the fast idle handle 11 rotates and contacts with the third edge 5*c* of the throttle grip 5, the throttle grip 5 and the throttle 3 are correspondingly driven to rotate clockwise, the throttle 3 will gradually rotate from an idling position to an opened position.

It can be shown that the throttle 3 rotates to the maximum throttle angle from FIG. 13*a* and FIG. 13*b*.

When the tenth edge 11*f* of the fast idle handle 11 drives the throttle grip 5 to rotate, the first peak 11*e* contacts with the third edge 5*c* of the throttle grip 5, such that the throttle grip 5 and the throttle 3 will be driven to rotate clockwise. The throttle 3 rotates from the idling position to the fully opened position. When the first peak 11*e* contacts with the sixth edge 5*f* of the throttle grip 5, the throttle 3 has the maximum throttle angle.

Figure 14A:
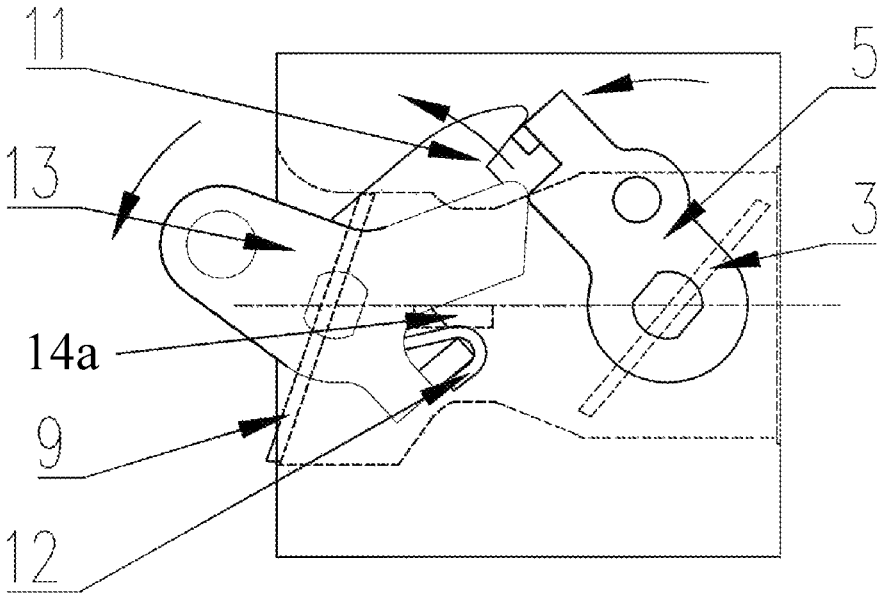
FIG. 14*a* is a perspective view of a fast idle handle rotating counter-clockwise at working of the throttle and choke control linkage mechanism in FIG. 13*a*.
Figure 14B:
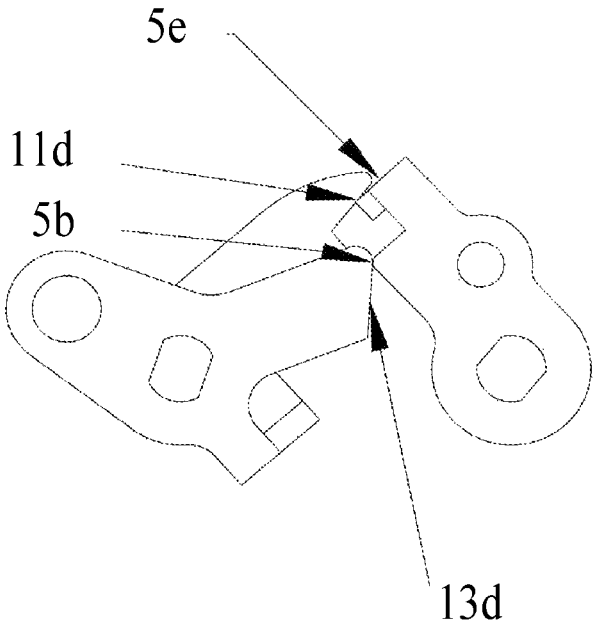
FIG. 14*b* is a perspective view of the fast idle handle, a throttle grip and a choke handle touching with each other of the throttle and choke control linkage mechanism in FIG. 14*a*.

Referring to FIG. 14*a* and FIG. 14*b*, when the choke handle 13 is continuously pulled, the fast idle handle 11 continuously rotates counter-clockwise, the fifth edge 5*e* of the throttle grip 5 will move toward the ninth edge 11*d* of the fast idle handle 11. And at the same time, the third peak 5*b* of the throttle grip 5 will touch a first surface 13*d* of the choke handle 13.

Figure 15A:
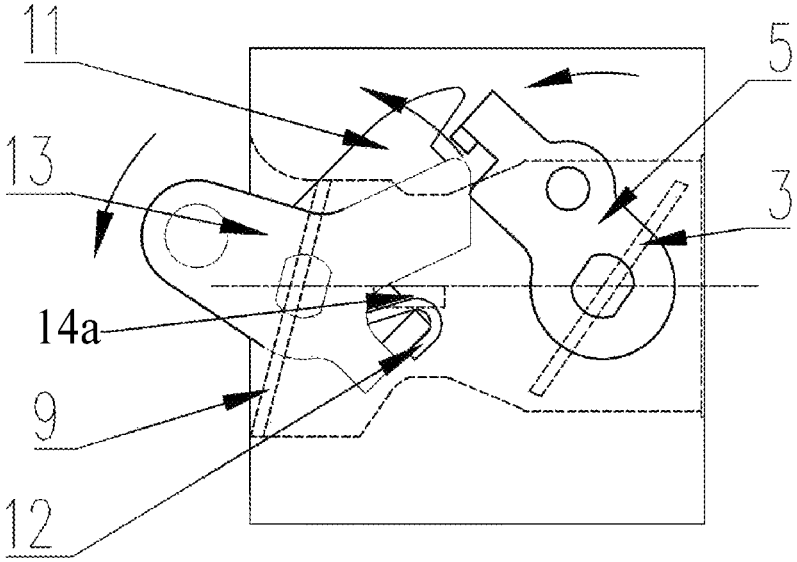
FIG. 15*a* is a perspective view of a choke valve at a fully closed position of the throttle and choke control linkage mechanism in FIG. 1.
Figure 15B:
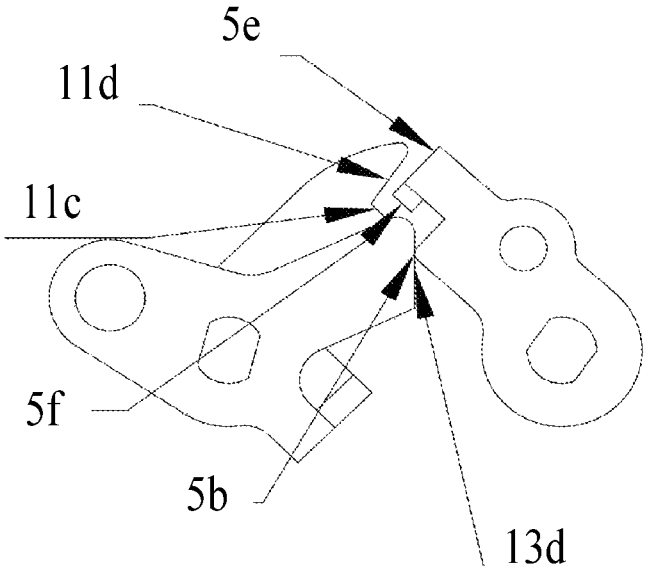
FIG. 15*b* is a perspective view of a fast idle handle, a throttle grip and a choke handle touching with each other of the throttle and choke control linkage mechanism in FIG. 15*a*.

Referring to FIG. 15*a* and FIG. 15*b*, the choke handle 13 will rotate continuously, such that the fast idle handle 11 continuously rotates until the choke valve 9 closes fully. Then, the third peak 5*b* of the throttle grip 5 is completely engaged with a middle of the first surface 13*d* of the choke handle 13. There are gaps between the fifth edge 5*e* and the ninth edge 11*d* and between the sixth edge 5*f* and the locking recess 11*c*, which are not in contact with each other.

Figure 16A:
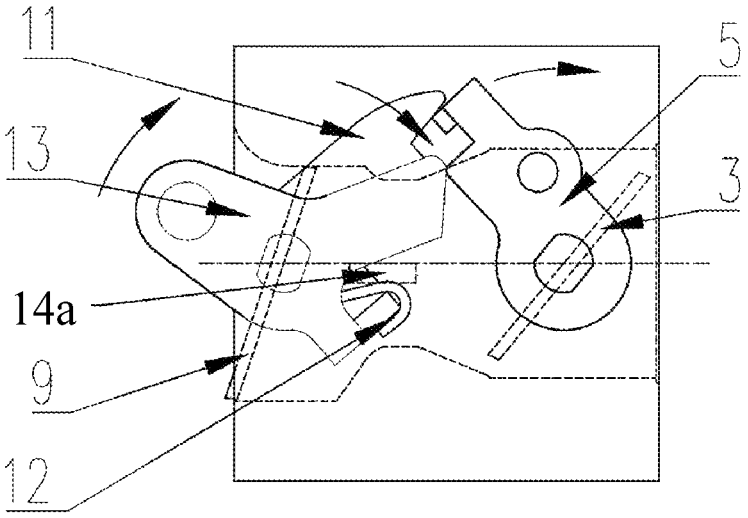
FIG. 16*a* is a perspective view of a fast idle handle rotating clockwise and stopping of the throttle and choke control linkage mechanism in FIG. 1.
Figure 16B:
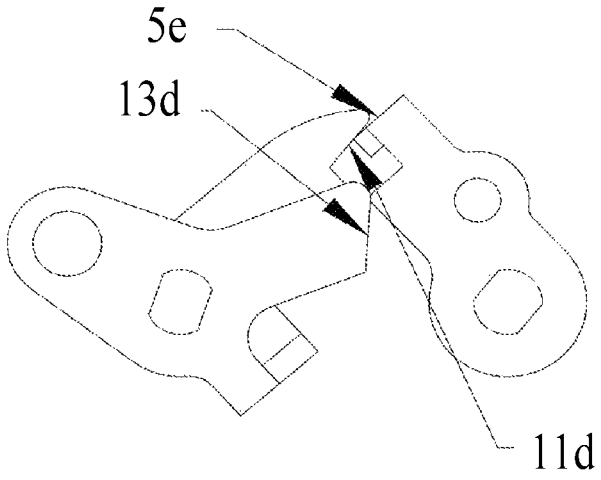
FIG. 16*b* is a perspective view of the fast idle handle, a throttle grip and a choke handle touching with each other of the throttle and choke control linkage mechanism in FIG. 16*a*.

Referring to FIG. 16*a* and FIG. 16*b*, the choke handle 13 drives the choke valve 9 to rotate clockwise, the first surface 13*d* will pull the throttle grip 5 to rotate clockwise. The fast idle handle 11 will rotate clockwise together under the torsion of the torsional spring 12, until that the ninth edge 11*d* touches and is stopped by the fifth edge 5*e* of the throttle grip 5. Then, the fast idle handle 11 will not rotate clockwise.

Figure 17A:
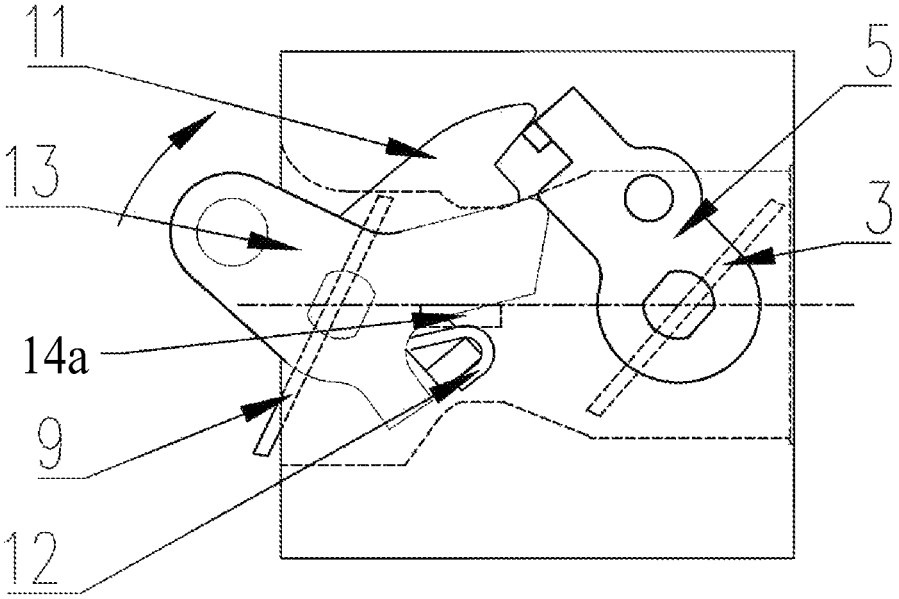
FIG. 17*a* is a perspective view of a throttle grip rotating and passing a second peak, until contacting with a fast idle handle of the throttle and choke control linkage mechanism in FIG. 1.
Figure 17B:
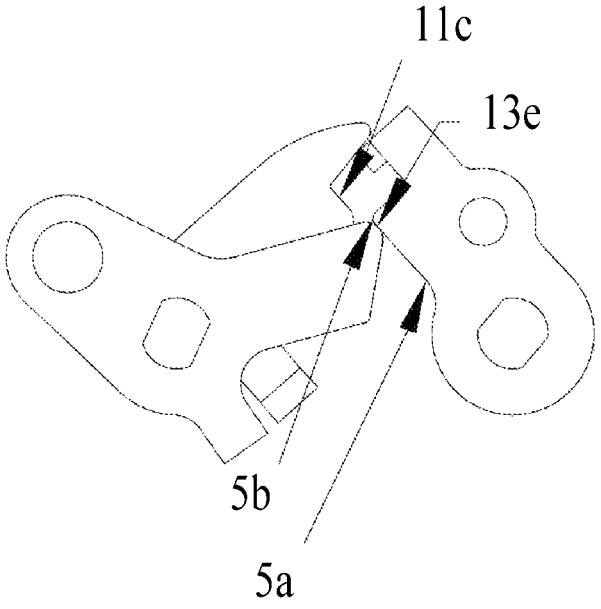
FIG. 17*b* is a perspective view of the throttle grip, the fast idle handle and a choke handle contacting with each other of the throttle and choke control linkage mechanism in FIG. 17*a*.

Referring to FIG. 17*a* and FIG. 17*b*, the choke handle 13 is pulled to rotate clockwise, a third surface 13*e* of the choke handle 13 will pass over the third peak 5*b* of the throttle grip 5 and slide along a first edge 5*a* of the throttle grip 5 until it departs from the first edge 5*a*. The throttle grip 5 will rotate counter-clockwise under the torsion of the torsional spring until it is locked within the locking recess 11*c* of the fast idle handle 11. Then, the throttle grip 5 will stop to rotate counter-clockwise.

Figure 18A:
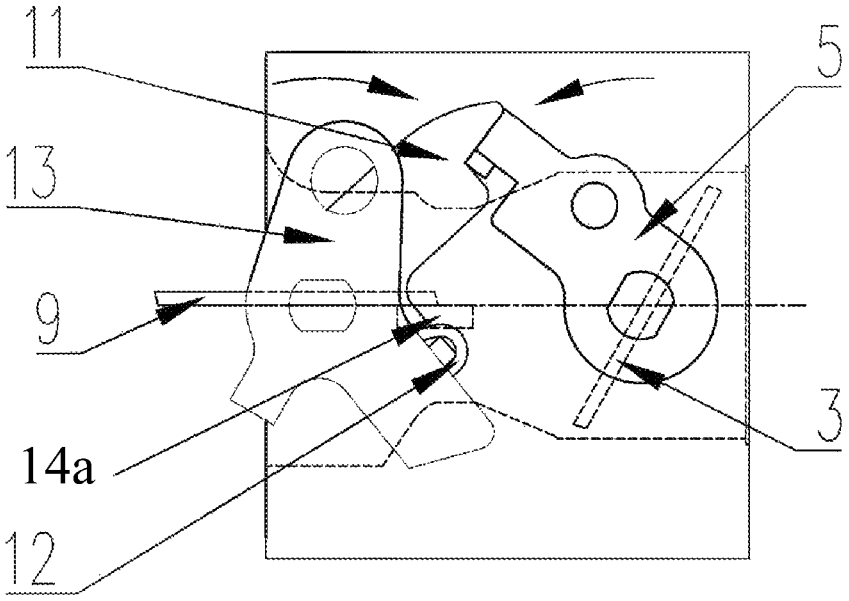
FIG. 18*a* is a perspective view of a fast idle handle and a throttle grip in a linked state of the throttle and choke control linkage mechanism in FIG. 1, when a choke valve is at a fully opened position.
Figure 18B:
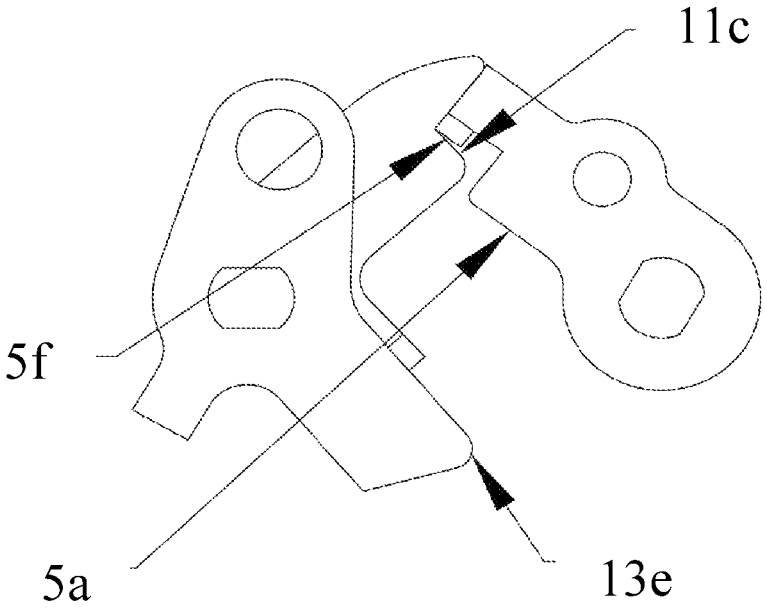
FIG. 18*b* is a perspective view of the throttle grip, the fast idle handle and the choke handle of the throttle and choke control linkage mechanism in FIG. 18*a*.

Referring to FIG. 18*a* and FIG. 18*b*, the choke handle 13 is continuously pulled to rotate clockwise, a third surface 13*e* of the choke handle 13 will departs completely from the first edge 5*a* of the throttle grip 5 until the choke valve 9 rotates clockwise to the fully opened position. At this time, the choke valve 9 is in contact with a block portion 14*a* of the main body 14. The sixth edge 5*f* of the throttle grip 5 is completely locked within the locking recess 11*c* of the fast idle handle 11.

Figure 19:
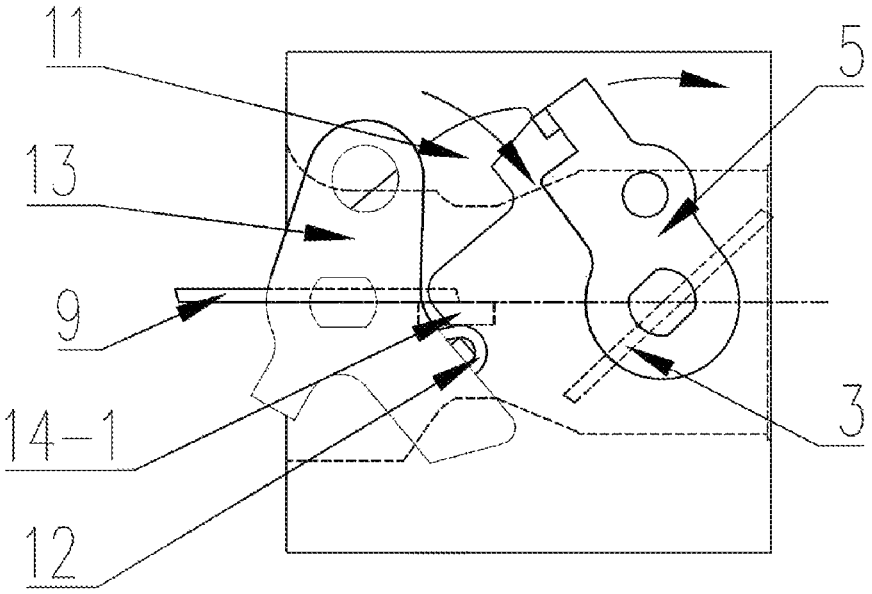
FIG. 19 is a perspective view of a fast idle handle and a throttle handle in a critical state of the throttle and choke control linkage mechanism in FIG. 1, when a throttle rotates from an idling position to a fully opened position.

Referring to FIG. 19, when the throttle 3 rotates from the idling position to the opened position, that is, the throttle grip 5 is pulled clockwise, the sixth edge 5*f* contacts with the first peak 11*e* of the fast idle handle 11, and the throttle grip 5 can be in a critical state.

Figure 20A:
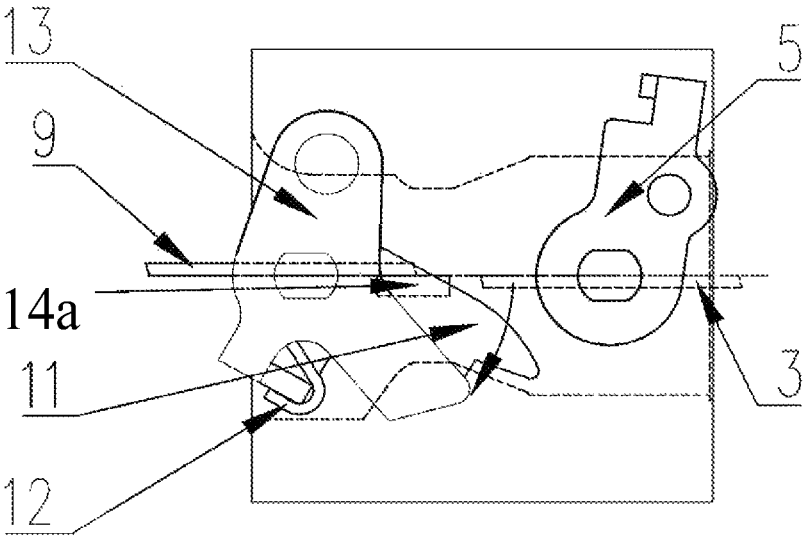
FIG. 20*a* is a perspective view of a choke valve and a throttle handle both being fully opened of the throttle and choke control linkage mechanism in FIG. 1.
Figure 20B:
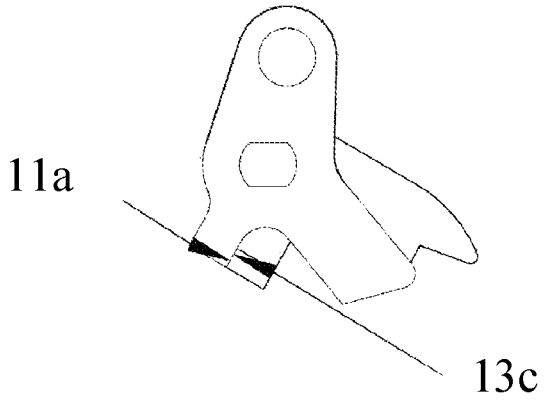
FIG. 20*b* is a perspective view of the choke valve and a fast idle handle contacting with each other of the throttle and choke control linkage mechanism in FIG. 20*a*.
Figure 21:
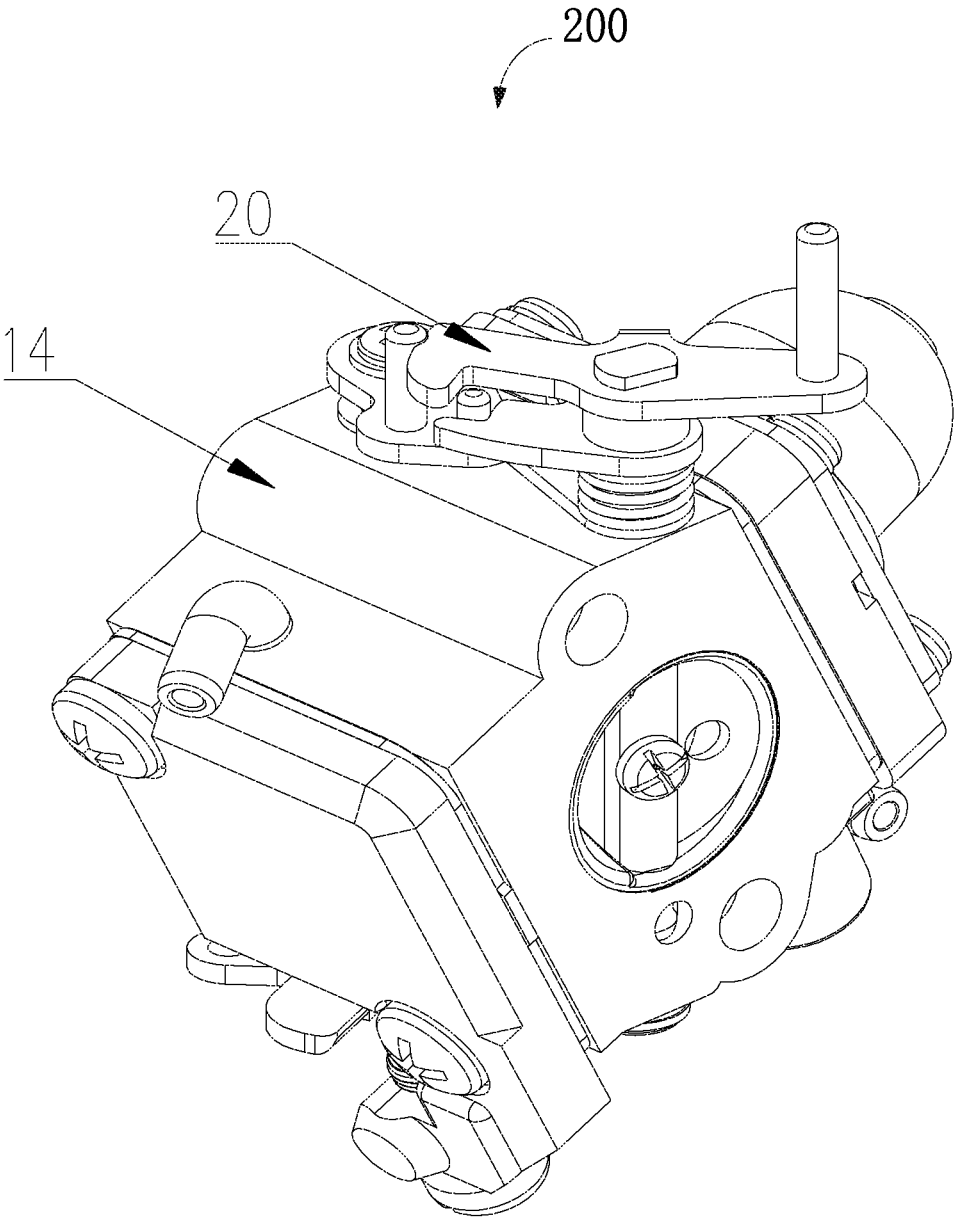
FIG. 21 is a perspective view of a throttle and choke control linkage mechanism in another embodiment of the present disclosure.
Figure 22:
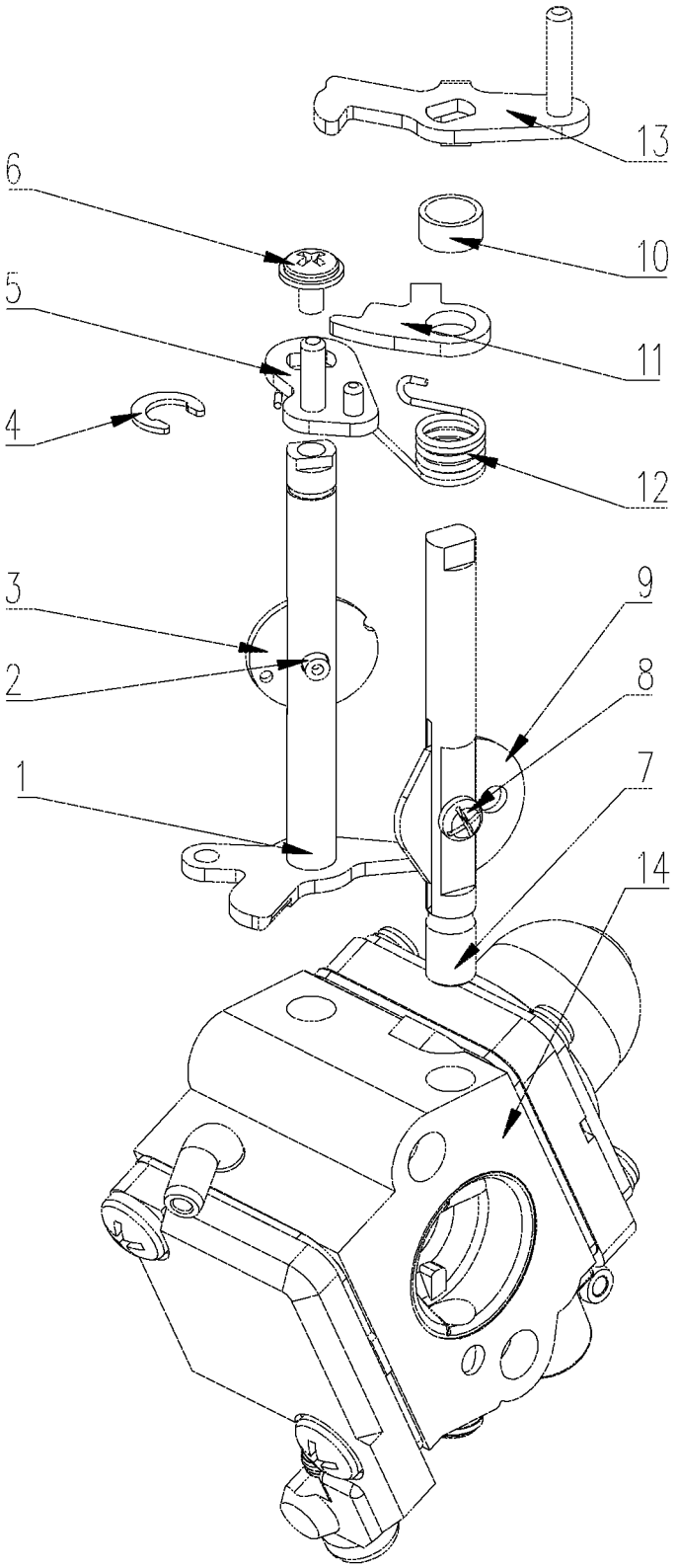
FIG. 22 is an exploded view of the throttle and choke control linkage mechanism in FIG. 21.
Figure 23:
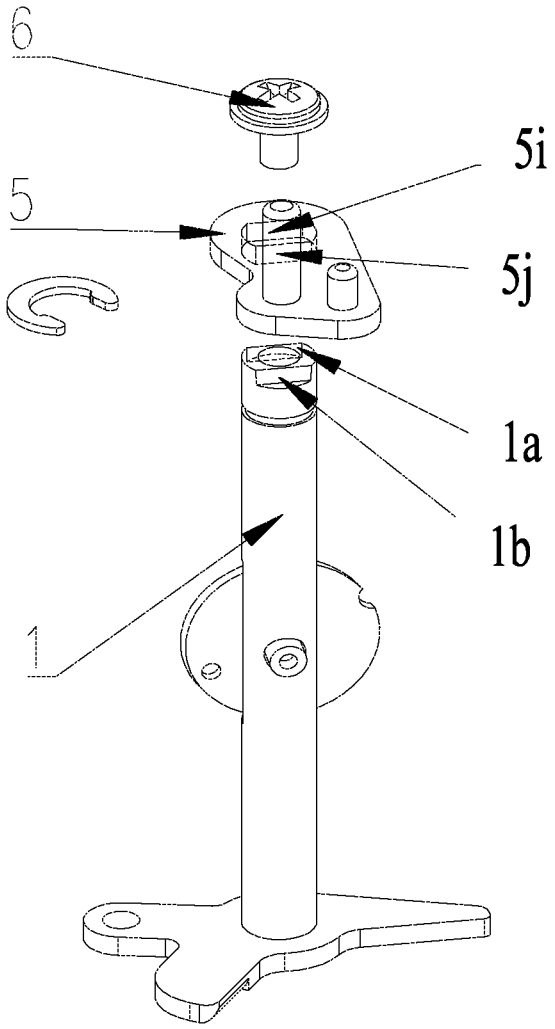
FIG. 23 is an exploded view of a throttle shaft of the throttle and choke control linkage mechanism in FIG. 21.
Figure 24:
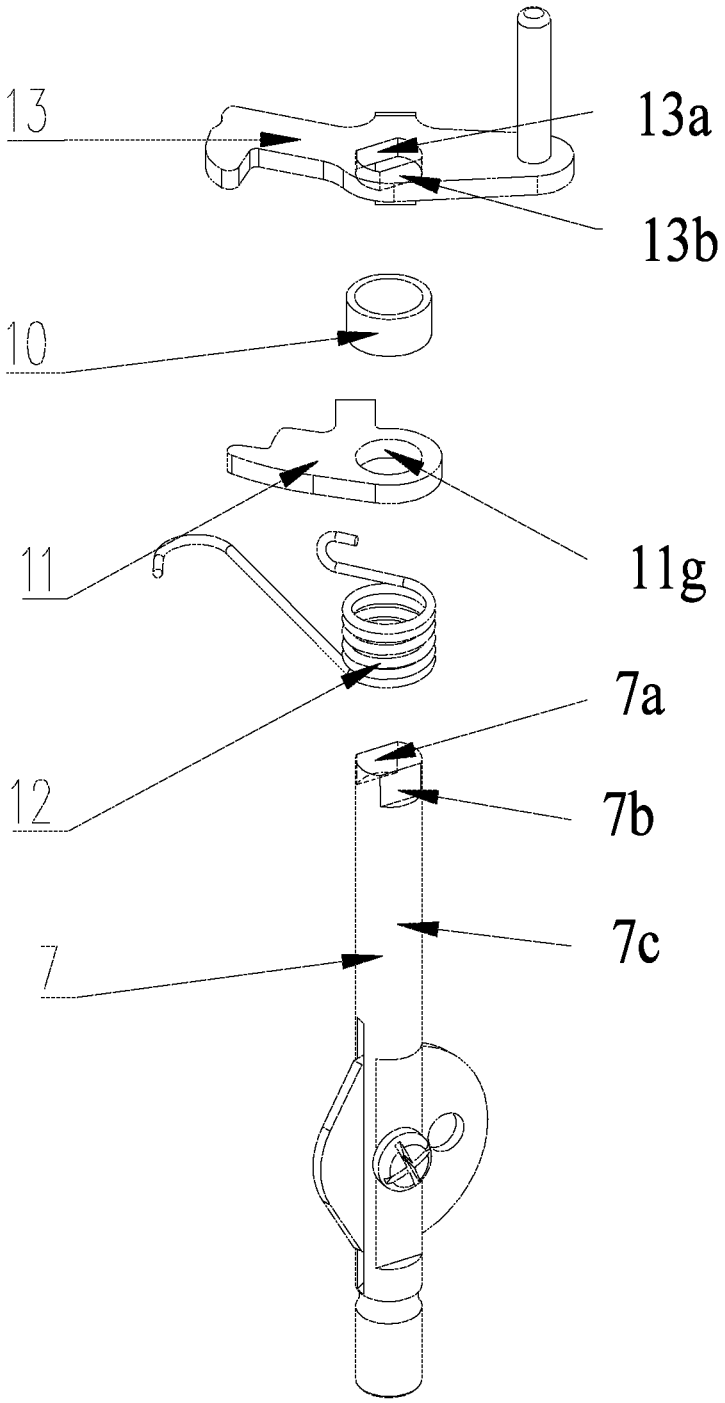
FIG. 24 is an exploded view of a choke shaft of the throttle and choke control linkage mechanism in FIG. 21.

It can be shown that an end state of the throttle and choke control linkage mechanism from FIG. 20*a* to FIG. 20*b*.

The throttle 3 is continuously operated. The throttle grip 5 continues to rotate clockwise, the first peak 11*e* of the fast idle handle 11 detaches from the sixth edge 5*f*. The fast idle handle 11 will rotate clockwise under the torsion of the torsional spring, until the seventh edge 11*a* of the fast idle handle 11 contacts the second surface 13*c* of the choke handle 13. The movement of the throttle and choke control linkage mechanism ends.

In another embodiment, referring to FIG. 21 to FIG. 24, another throttle and choke control linkage mechanism in a carburetor 200 is provided. The structure and connection relationship between the various components of the carburetor 200 is substantially the same as that of the carburetor 100, except for the structures of the throttle grip 5 and the choke handle 13. Therefore, the structures of the throttle grip 5 and the choke handle 13, and working process of the carburetor 200 will be explained.

Figure 25:
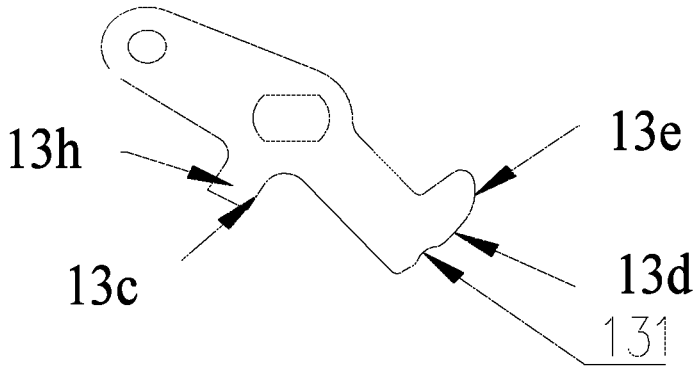
FIG. 25 is a perspective view of a choke handle of the throttle and choke control linkage mechanism in FIG. 21.

Referring to FIG. 25, the first surface 13*d* is further provided with a concave portion 131. The concave portion 131 is configured for linking with the throttle grip 5.

Figure 26:
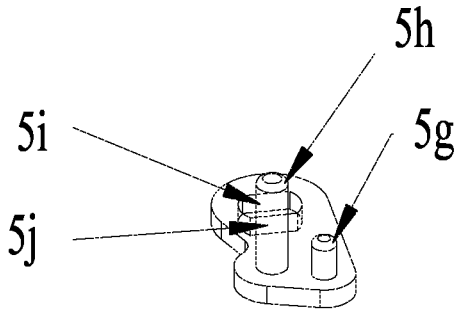
FIG. 26 is a perspective view of a throttle grip of the throttle and choke control linkage mechanism in FIG. 21.
Figure 27:
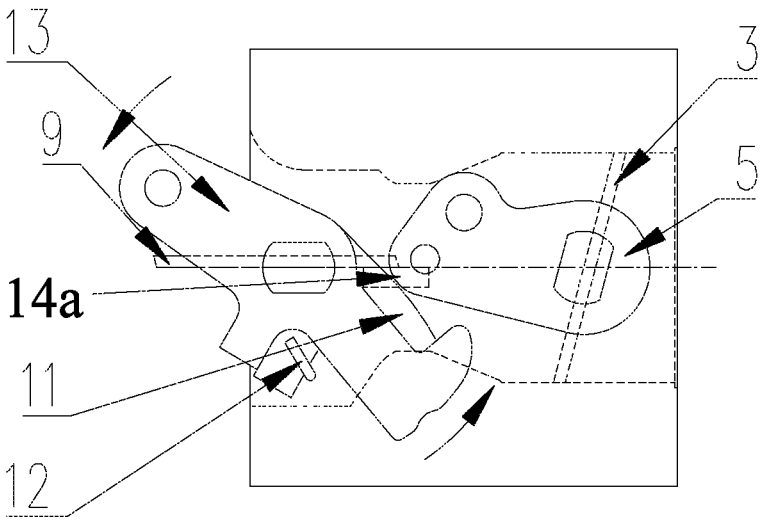
FIG. 27 is a perspective view of a choke valve at a fully opened position and a throttle at a fully closed position of the throttle and choke control linkage mechanism in FIG. 21.

Referring to FIG. 26, the throttle grip 5 is provided with a first linkage shaft 5*g* and a second linkage shaft 5*h*. The first linkage shaft 5*g* is configured for engaging the fast idle handle 11, and the second linkage shaft 5*h* is configured for engaging the choke handle 13.

Preferably, the first linkage shaft 5*g* and the second linkage shaft 5*h* are vertically disposed on the throttle grip 5, that is, an axis of the first linkage shaft 5*g* can be vertical to a surface of the throttle grip 5 and parallel to an axis of the second linkage shaft 5*h*. Of course, in other embodiments, the axis of the first linkage shaft 5*g* and the axis of the second linkage shaft 5*h* may not be disposed in parallel.

Referring to FIG. 27, FIG. 28*a*, FIG. 28*b*, FIG. 29*a*, FIG. 29*b*, FIG. 30*a*, FIG. 30*b*, FIG. 30*c*, FIG. 31*a*, FIG. 31*b*, and FIG. 31*c*, it shows a process of the choke valve 9 from a fully opening position to a fully closing position.

When the choke valve 9 is at the fully opening position, the seventh edge 11*a* of the fast idle handle 11 is in close contact with the first face 13*c* of the choke handle 13 by the torsion of the torsional spring 12 (as shown in FIG. 20*b*). When the choke valve 9 is rotated from the fully opening position to the fully closed position, that is, when the choke handle 13 is pulled to rotate counterclockwise, the fast idle handle 11 can be driven to rotate counterclockwise by the choke handle 13.

Figure 28A:
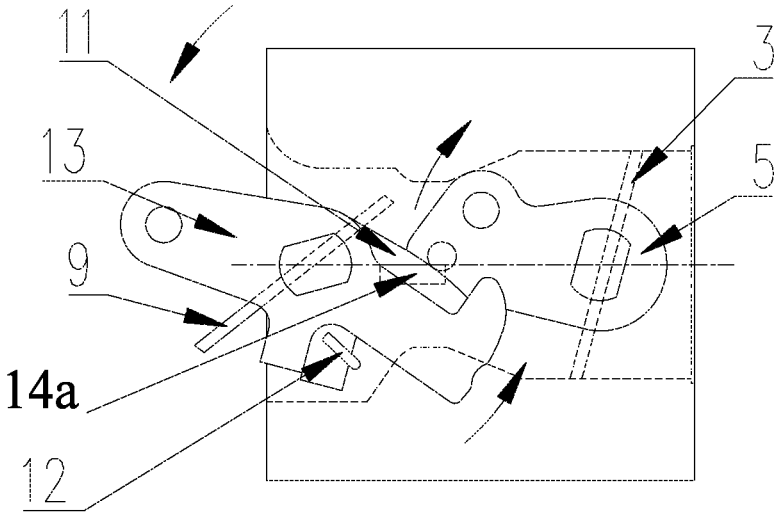
FIG. 28*a* is a perspective view of a choke handle and a fast idle handle of the throttle and choke control linkage mechanism in FIG. 1, which are in a linked state.
Figure 28B:
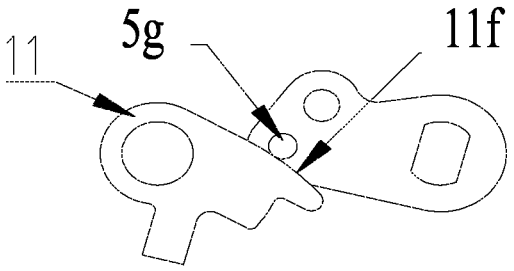
FIG. 28*b* is a perspective view of a choke handle and a fast idle handle of the throttle and choke control linkage mechanism in FIG. 28*a*, which are in a contacting state.

Specifically, referring to FIG. 28*a* to FIG. 28*b*, a process of the throttle 3 from the idling position to the opened position is showed.

When the tenth edge 11*f* of the fast idle handle 11 rotates and contacts with the first linkage shaft 5*g* of the throttle grip 5, the throttle grip 5 and the throttle 3 are driven to rotate clockwise, and the throttle 3 will gradually rotate from the idling position to the opened position.

Figure 29A:
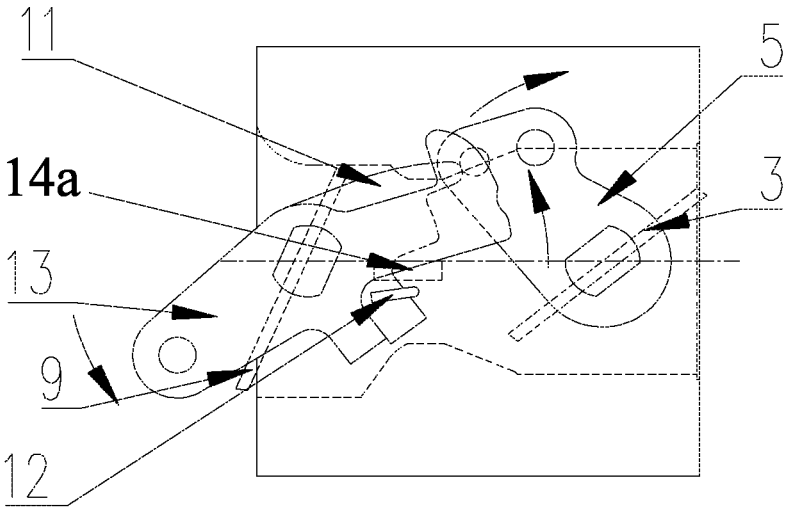
FIG. 29*a* is a perspective view of a throttle rotating to a maximum opening angle (critical state) of the throttle and choke control linkage mechanism in FIG. 21.
Figure 29B:
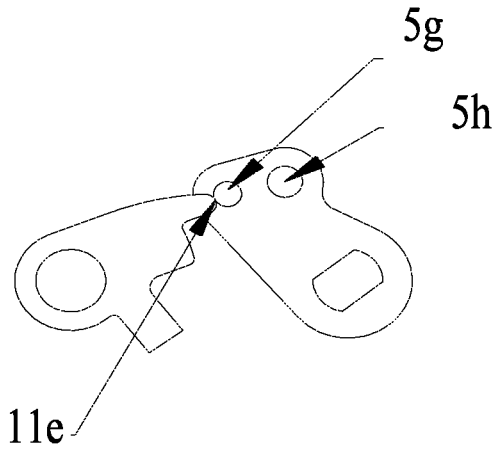
FIG. 29*b* is a perspective view of a fast idle handle and a throttle grip in the critical state of the throttle and choke control linkage mechanism in FIG. 29*a*.

It can be shown that the throttle 3 rotates to the maximum throttle angle from FIG. 29*a* and FIG. 29*b*.

When the tenth edge 11*f* of the fast idle handle 11 drives the throttle grip 5 to rotate, the first peak 11*e* contacts with the first linkage shaft 5*g* of the throttle grip 5, such that the throttle 3 rotates from the idling position to the fully opened position. When the first peak 11*e* contacts with the first linkage shaft 5*g* of the throttle grip 5, the throttle 3 has the maximum throttle angle.

Figure 30A:
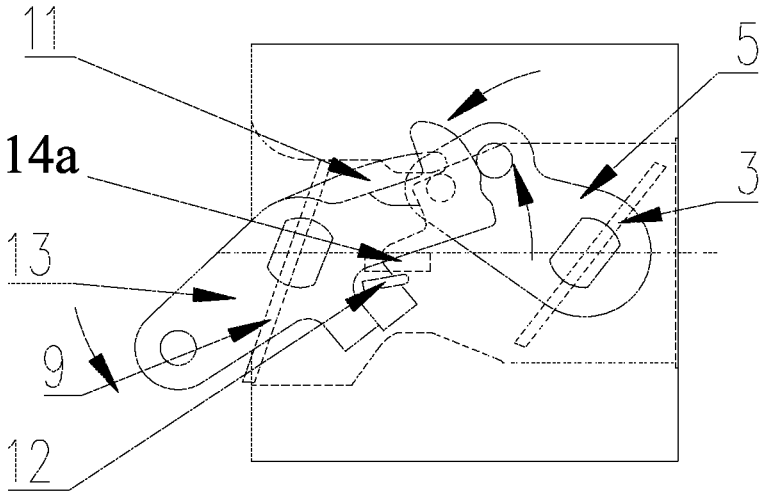
FIG. 30*a* is a perspective view of a choke handle and a throttle grip of the throttle and choke control linkage mechanism in FIG. 21, which just contact each other.
Figure 30B:
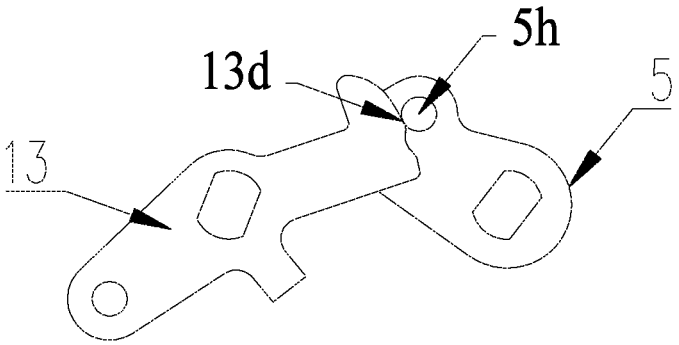
FIG. 30*b* is a perspective view of a choke handle and a throttle grip of the throttle and choke control linkage mechanism in FIG. 21, which are in a linked state.
Figure 30C:
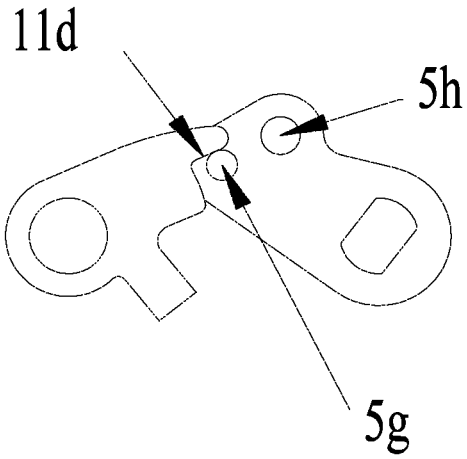
FIG. 30*c* is a perspective view of a fast idle handle and a throttle grip of the throttle and choke control linkage mechanism in FIG. 21, which are in a linked state.

Referring to FIG. 30*a*, FIG. 30*b*, and FIG. 30*c*, when the choke handle 13 is continuously pulled, the fast idle handle 11 continuously rotates counter-clockwise, the first linkage shaft 5*g* of the throttle grip 5 will move to the ninth edge 11*d* of the fast idle handle 11, but not contact the locking recess 11*c*. And at the same time, the second linkage shaft 5*h* of the throttle grip 5 will touch the first surface 13*d* of the choke handle 13.

Figure 31A:
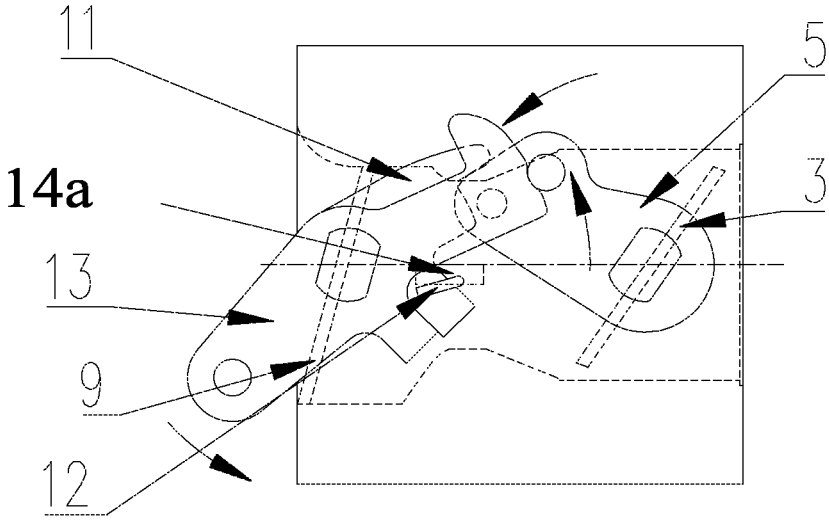
FIG. 31*a* is a perspective view of a choke valve at a fully closed position of the throttle and choke control linkage mechanism in FIG. 21.
Figure 31B:
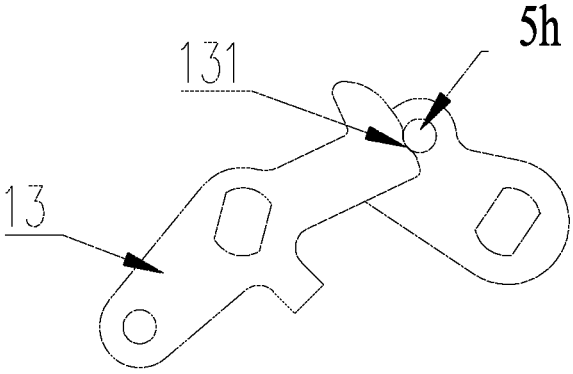
FIG. 31*b* is a perspective view of a throttle grip and a choke valve being in a linked state of the throttle and choke control linkage mechanism in FIG. 31*a*.
Figure 31C:
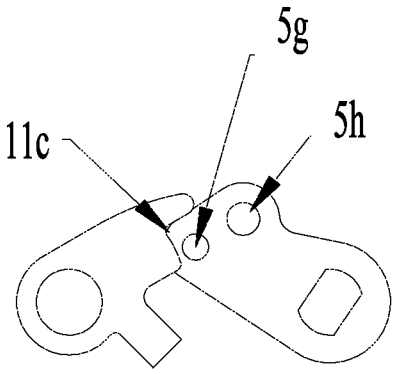
FIG. 31*c* is a perspective view of a throttle grip and a fast idle handle being in a linked state of the throttle and choke control linkage mechanism in FIG. 31*a*.

Referring to FIG. 31*a*, FIG. 31*b*, and FIG. 31*c*, the choke handle 13 will rotate continuously, such that the fast idle handle 11 continuously rotates until the choke valve 9 closes fully. Then, the second linkage shaft 5*h* of the throttle grip 5 is completely engaged with the concave portion 131 of the first surface 13*d*. There are gaps between the first linkage shaft 5*g* and the ninth edge 11*d* and between the first linkage shaft 5*g* and the locking recess 11*c*, which are not in contact with each other.

Figure 32A:
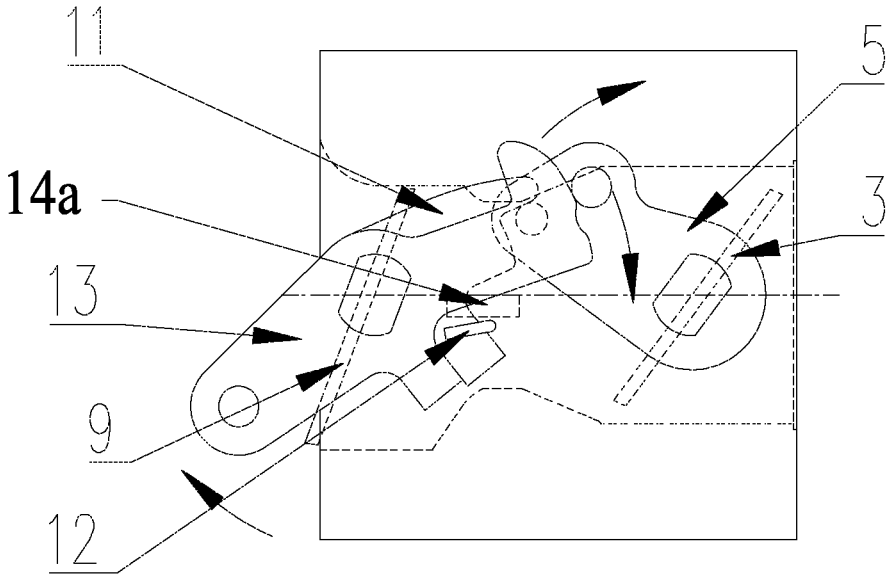
FIG. 32*a* is a perspective view of a throttle grip touching with a choke handle and a fast idle handle of the throttle and choke control linkage mechanism in FIG. 21, when the choke valve is rotated clockwise.
Figure 32B:
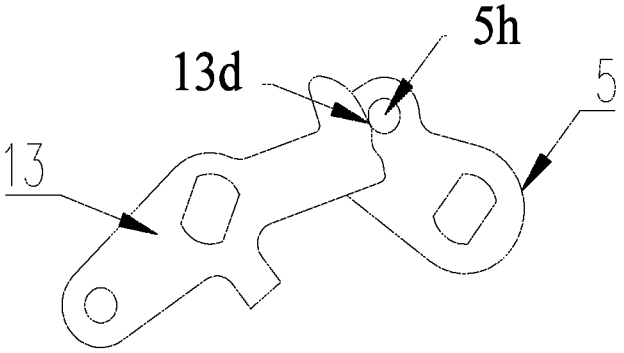
FIG. 32*b* is a perspective view of the throttle grip touching with the choke handle of the throttle and choke control linkage mechanism in FIG. 32*a*.
Figure 32C:
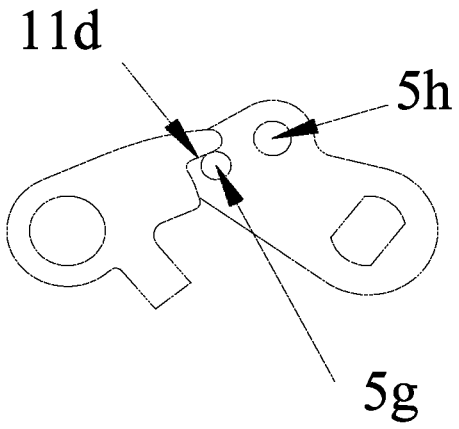
FIG. 32*c* is a perspective view of the throttle grip touching with the fast idle handle of the throttle and choke control linkage mechanism in FIG. 32*a*.

Referring to FIG. 32*a*, FIG. 32*b* and FIG. 32*c*, the choke handle 13 drives the choke valve 9 to rotate clockwise, the second surface 13*e* will pull the throttle grip 5 to rotate clockwise. The fast idle handle 11 will rotate clockwise together under the torsion of the torsional spring 12, until that the ninth edge 11*d* touches and is stopped by the first linkage shaft 5*g* of the throttle grip 5. Then, the fast idle handle 11 will not rotate clockwise.

Figure 33A:
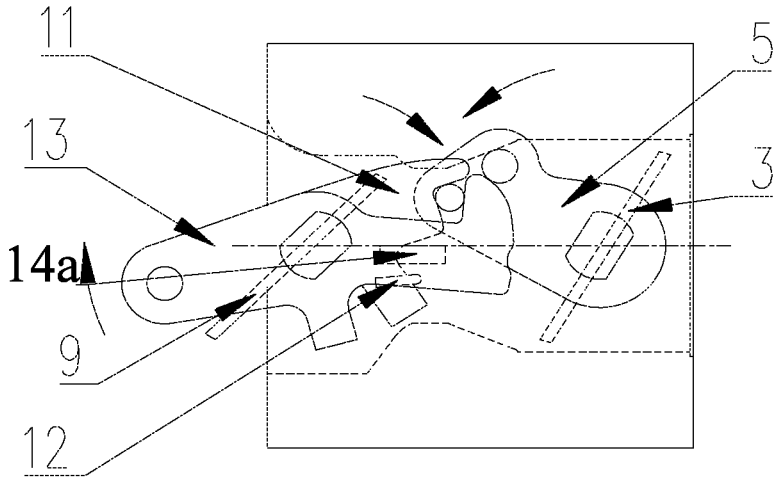
FIG. 33*a* is a perspective view of the throttle grip stopped to rotate of the throttle and choke control linkage mechanism in FIG. 21.
Figure 33B:
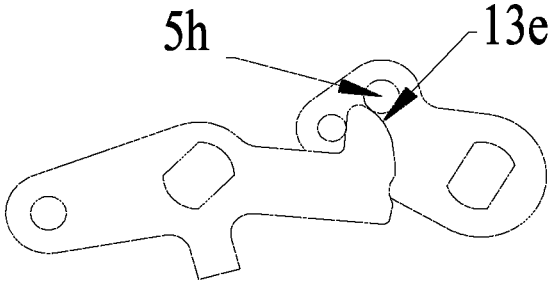
FIG. 33*b* is a perspective view of the throttle grip and a choke handle in a linked state of the throttle and choke control linkage mechanism in FIG. 21.
Figure 34:
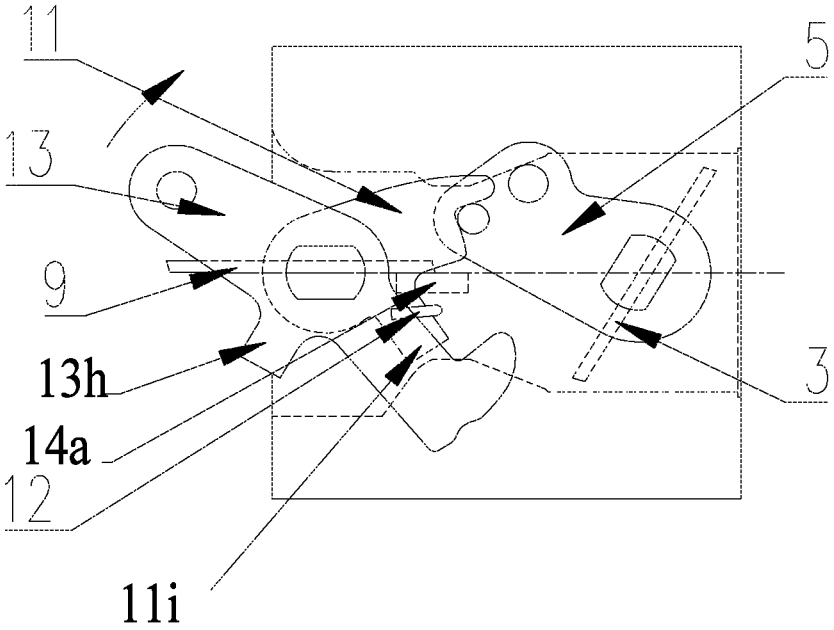
FIG. 34 is a perspective view of a throttle grip locked by a fast idle handle of the throttle and choke control linkage mechanism in FIG. 21, when a choke valve is at a fully opened position.

Referring to FIG. 33*a* and FIG. 33*b*, the choke handle 13 is pulled to rotate clockwise, a third surface 13*e* of the choke handle 13 will not contact with the second linkage shaft 5*h*. At the time, the throttle grip 5 will rotate counter-clockwise under the torsion of the torsional spring until it is locked within the locking recess 11*c* of the fast idle handle 11 (as shown in FIG. 34). Then the throttle grip 5 will stop to rotate counter-clockwise.

Referring to FIG. 34, the choke handle 13 is continuously pulled to rotate clockwise, a third surface 13*e* of the choke handle 13 will departs completely from the second linkage shaft 5*h* of the throttle grip 5 until the choke valve 9 rotates clockwise to the fully opened position. At this time, the choke valve 9 is in contact with the block portion 14*a* of the main body 14. The first linkage shaft 5*g* of the throttle grip 5 is completely locked within the locking recess 11*c* of the fast idle handle 11, and there is a gap between the second convex portion 11*i* and the first convex portion 13*h*.

Figure 35:
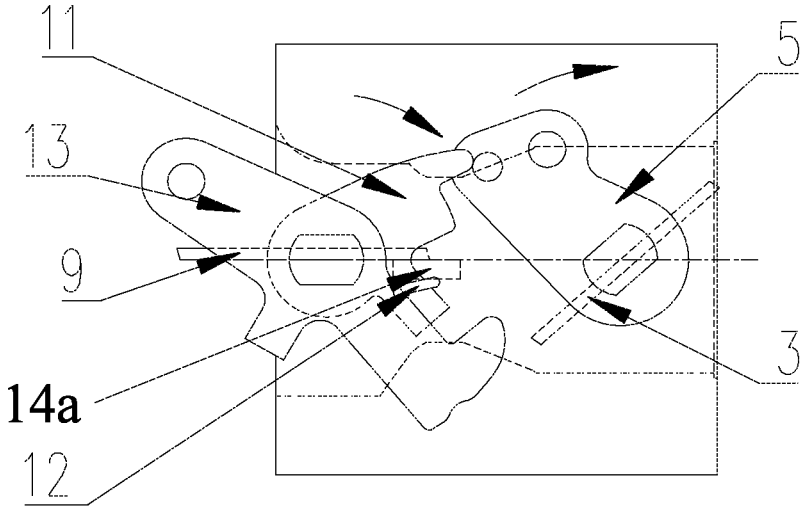
FIG. 35 is a perspective view of a fast idle handle and a throttle handle in a critical state of the throttle and choke control linkage mechanism in FIG. 21, when a throttle rotates from an idling position to a fully opened position.

Referring to FIG. 35, when the throttle 3 rotates from the idling position to the opened position, that is, the throttle grip 5 is pulled clockwise, the first linkage shaft 5*g* contacts with the first peak 11*e* of the fast idle handle 11, and the throttle grip 5 can be in the critical state.

Figure 36:
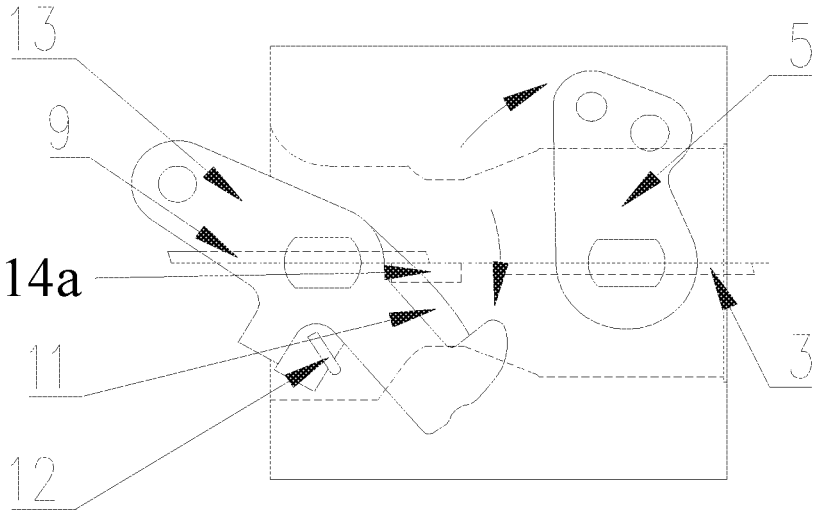
FIG. 36 is a perspective view of a choke valve and a throttle handle both being fully opened of the throttle and choke control linkage mechanism in FIG. 1.
Figure 37:
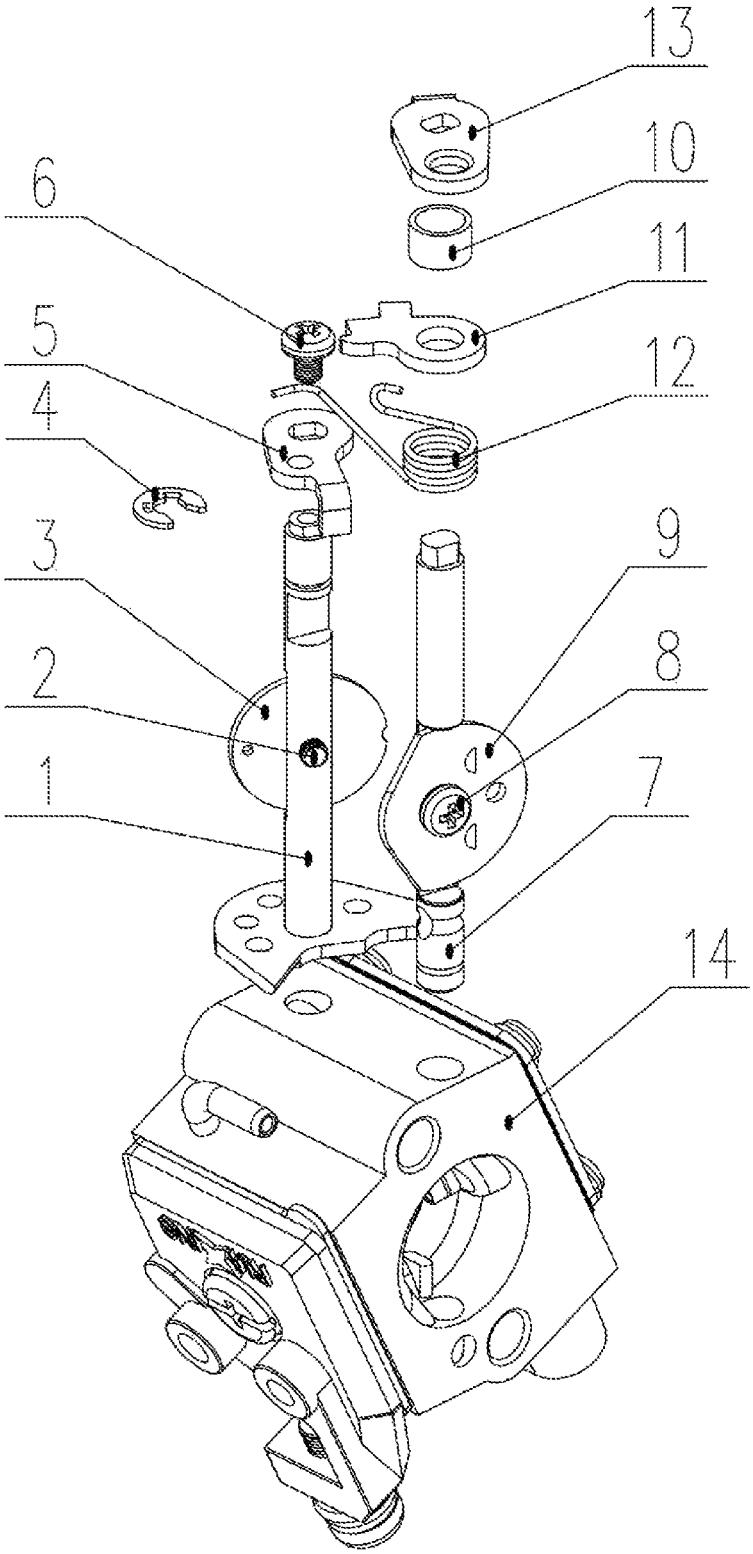
FIG.37(prior art)
FIG. 37 is a perspective view of a carburetor of the prior art.
Figure 38:
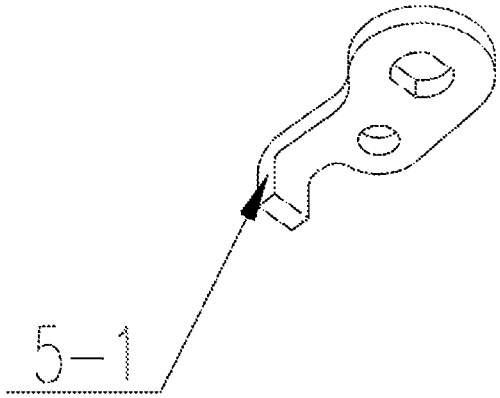
FIG.38(prior art)
FIG. 38 is a perspective view of a throttle handle of the carburetor in FIG. 37.
Figure 39:
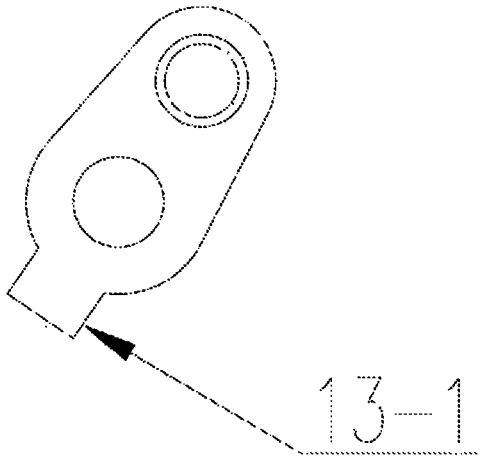
FIG.39(prior art)
FIG. 39 is a perspective view of a choke handle of the carburetor in FIG. 37.
Figure 40:
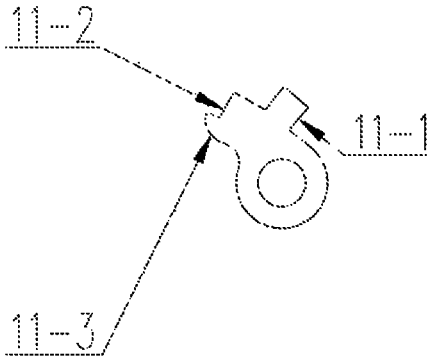
FIG.40(prior art)
FIG. 40 is a perspective view of a fast idle handle of the carburetor in FIG. 37.
Figure 41:
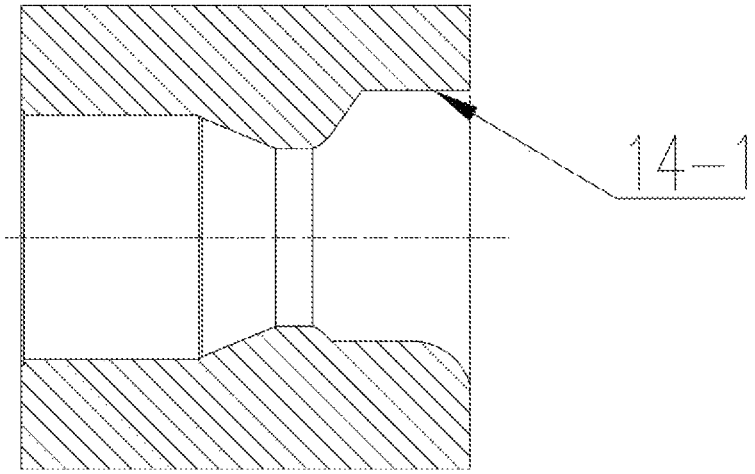
FIG.41(prior art)
FIG. 41 is a cross-sectional view of a main body of the carburetor in FIG. 37.
Figure 42:
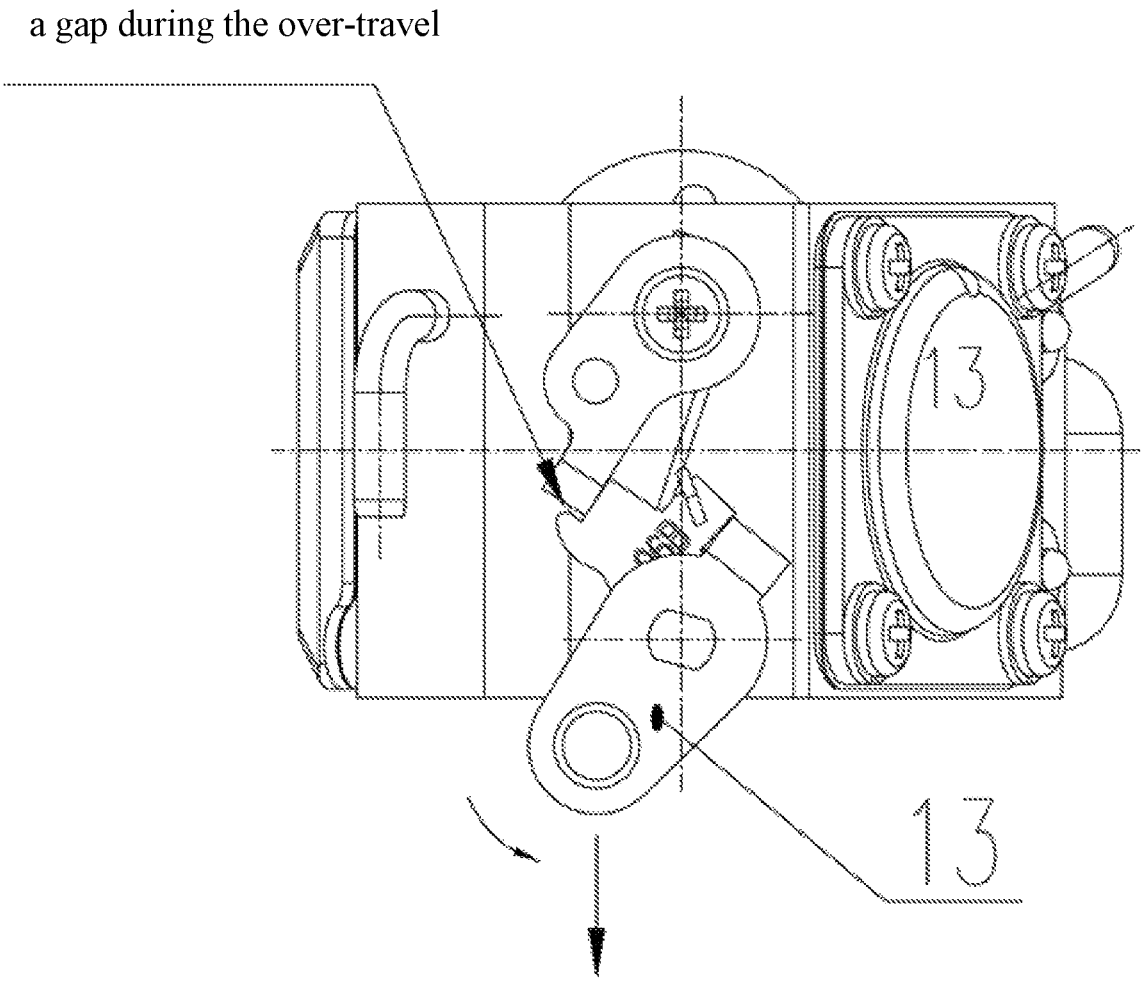
FIG.42(prior art)
FIG. 42 is a perspective view of the carburetor in an over travel state in FIG. 37.
Figure 43:
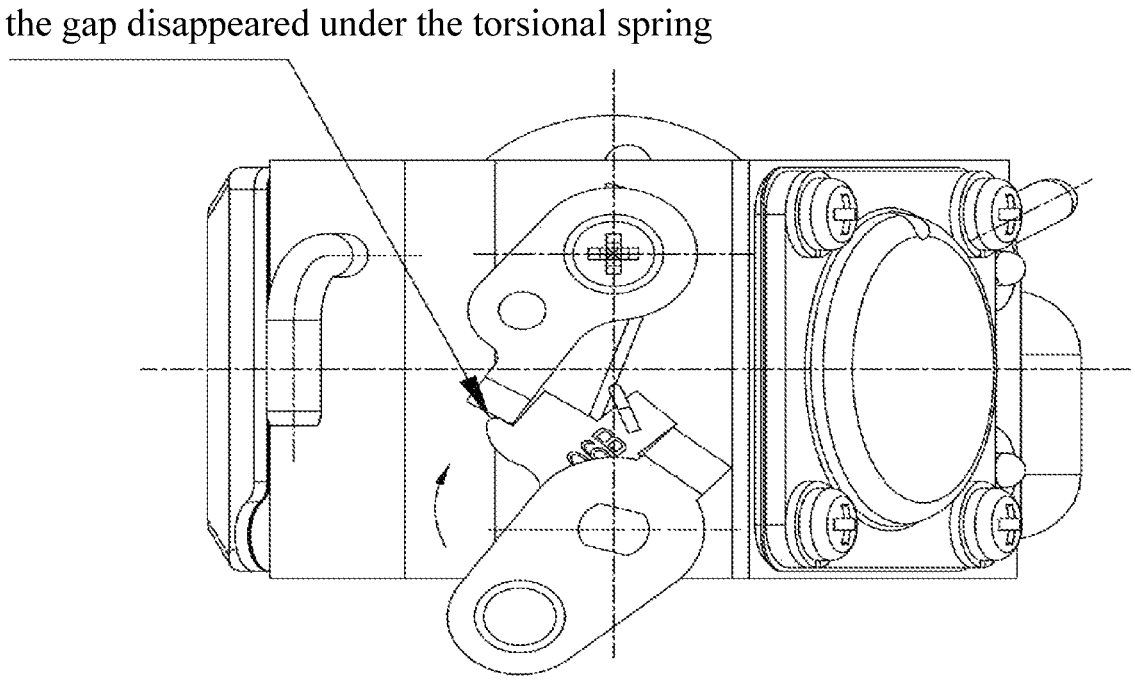
FIG.43(prior art)
FIG. 43 is a perspective view of the carburetor in FIG. 37, in a return state under torsional spring of a choke valve.
Figure 44:
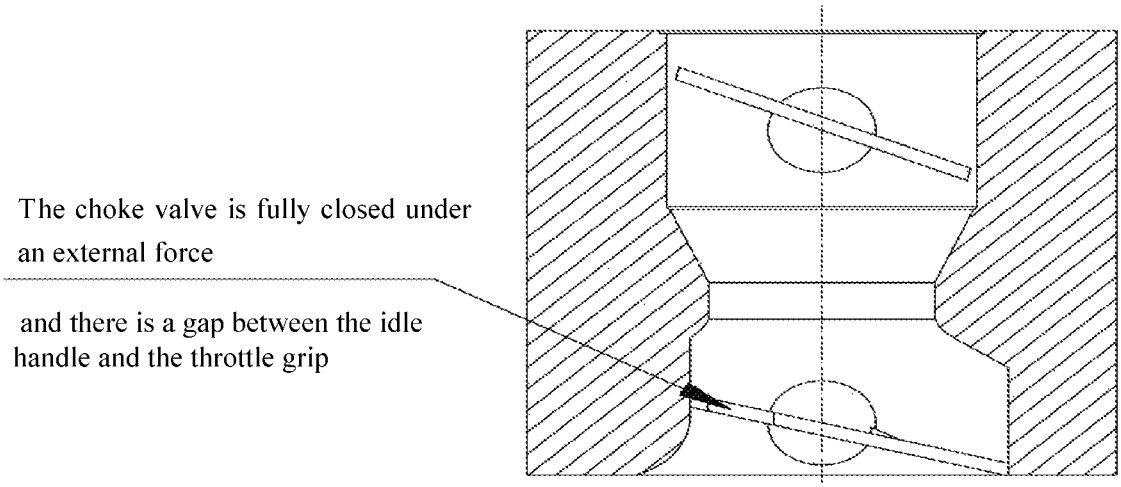
FIG.44(prior art)
FIG. 44 is a perspective view of the carburetor with the choke valve fully closed in FIG. 37.
Figure 45:
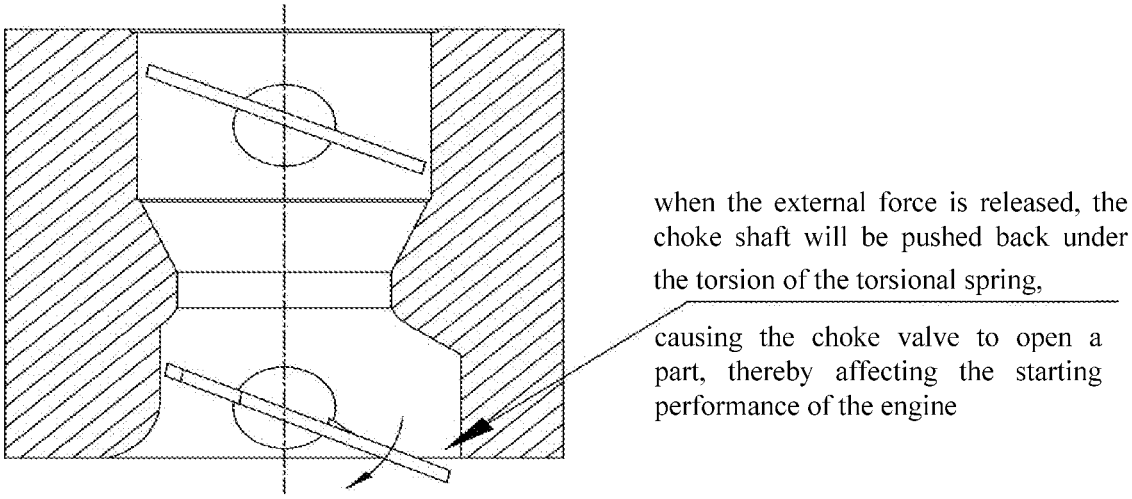
FIG.45(prior art)
FIG. 45 is a perspective view of the carburetor in FIG. 37, in which the choke shaft is reversely pushed under the action of the torsion spring after the external force is lost, causing the choke valve to open partly.
Figure 46:
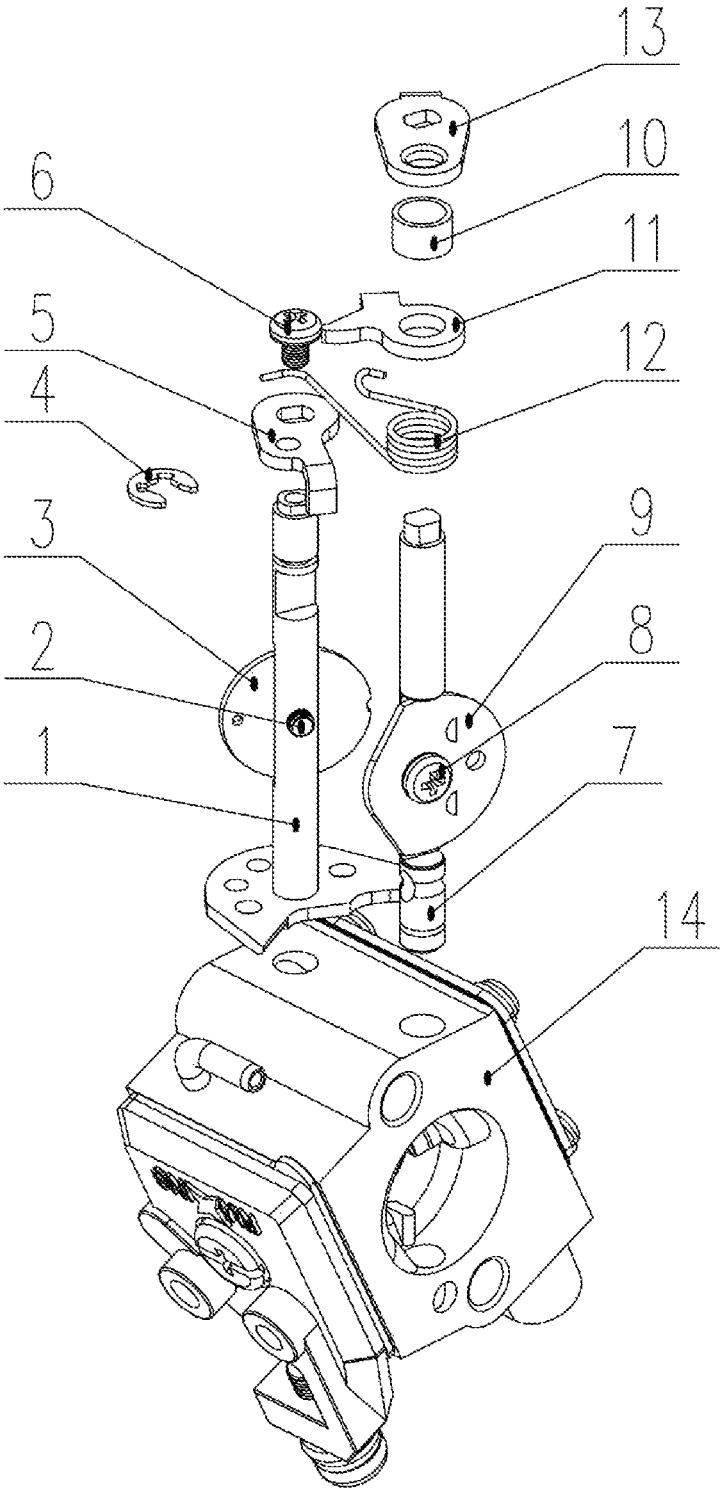
FIG.46(prior art)
FIG. 46 is a perspective view of another carburetor of the prior art.
Figure 47:
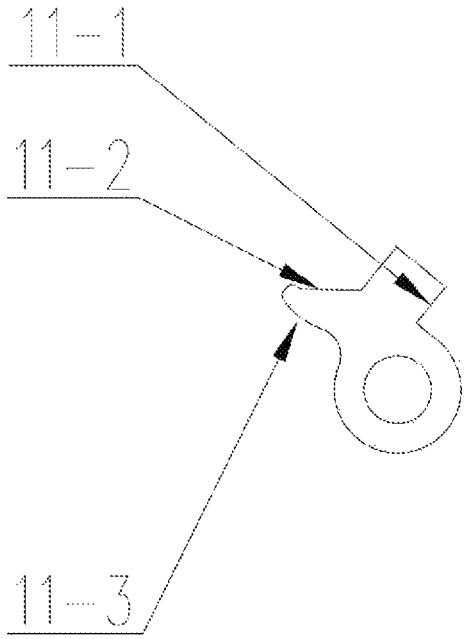
FIG.47(prior art)
FIG. 47 is a perspective view of a fast idle handle of the carburetor in FIG. 46.
Figure 48:
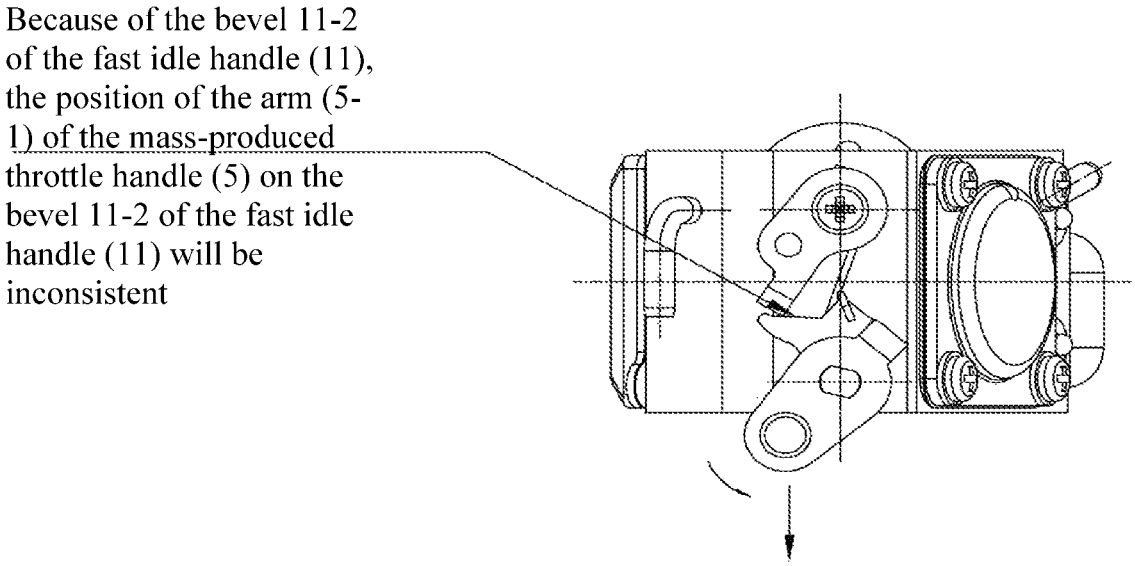
FIG.48(prior art)
FIG. 48 is a perspective view of the carburetor in FIG. 46 in a linked state.
Figure 49:
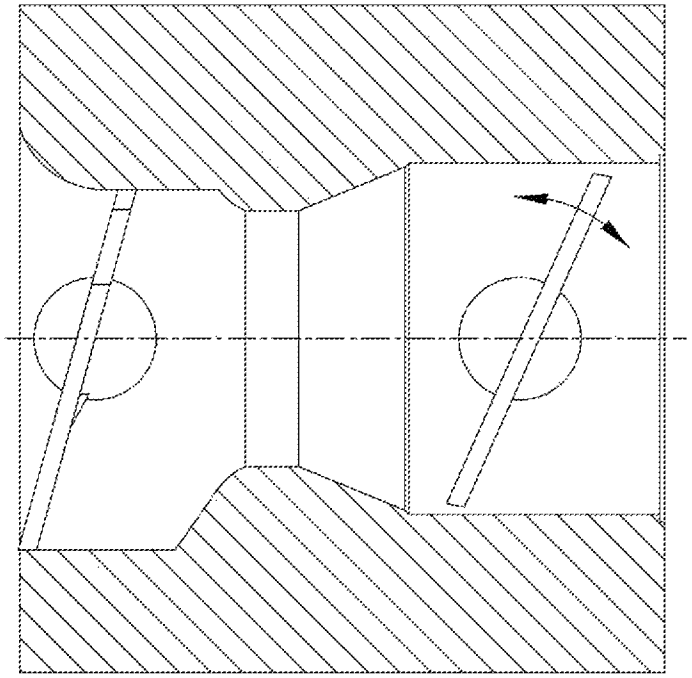
FIG.49(prior art)
FIG. 49 is a perspective view of the carburetor in FIG. 46 with the choke valve fully closed.

It can be shown that an end state of the throttle and choke control linkage mechanism from FIG. 36.

The throttle 3 is continuously operated. The throttle grip 5 continues to rotate clockwise, the first peak 11*e* of the fast idle handle 11 detaches from the first linkage shaft 5*g*. The fast idle handle 11 will rotate clockwise under the torsion of the torsional spring, until the seventh edge 11*a* of the fast idle handle 11 contacts with the second surface 13*c* of the choke handle 13, and there is no gap between the second convex portion 11*i* and the first convex portion 13*h*. The movement of the throttle and choke control linkage mechanism ends.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A throttle and choke control linkage mechanism of carburetor, comprising:

a choke shaft rotatably installed with a choke valve;

a throttle shaft rotatably installed with a throttle;

a choke handle fixed on the choke shaft and configured for rotating the choke valve from a fully opened position to a fully closed position or from the fully closed position to the fully opened position;

a throttle grip fixed on the throttle shaft and configured for rotating the throttle from an idling position to an opened position; and a fast idle handle being able to rotate freely around the choke shaft, the fast idle handle further carrying a first end of a torsional spring, which has a second end connected with the choke shaft;

wherein when the choke handle is pulled, the choke valve is rotated from the fully opened position to the fully closed position, the fast idle handle is disposed on the choke shaft which is deflected by the torsional spring and rotatable along a first path, the throttle grip is rotatable along a second path which is coplanar and intersects with the first path;

the fast idle handle is provided with a locking recess configured for locking the throttle grip, when the choke handle departs from the throttle grip, the throttle is at the idling position and the throttle grip is locked within the locking recess, the choke handle is further provided with a first surface which is able to link with the throttle grip, when the choke handle is linked with the throttle grip, the choke valve is at the fully closed position, and the throttle is opened with an angle larger than the idling position.

2. The throttle and choke control linkage mechanism of carburetor of claim 1, wherein when the choke handle is linked with the throttle grip, the throttle grip is not locked by the locking recess, and there is a gap between the throttle grip and the fast idle handle.

3. The throttle and choke control linkage mechanism of carburetor of claim 1, wherein the choke shaft and the throttle grip are linked with each other via the torsional spring.

4. The throttle and choke control linkage mechanism of carburetor of claim 1, wherein at least one of the choke handle and the fast idle handle is provided with a convex portion, the fast idle handle is in contact with the choke handle under the torsional spring, when the choke handle is pulled, the choke valve is rotated from the fully opened position to the fully closed position, the fast idle handle and the choke handle will rotate, and the choke handle is finally linked with the throttle grip.

5. The throttle and choke control linkage mechanism of carburetor of claim 1, wherein the fast idle handle is rotatably fixed on the choke shaft.

6. The throttle and choke control linkage mechanism of carburetor of claim 1, wherein the fast idle handle comprises a first through hole with a cylindrical shape, the fast idle handle further has a first peak.

7. The throttle and choke control linkage mechanism of carburetor of claim 6, wherein when the fast idle handle rotates until the first peak contacts a sixth edge of the throttle grip, the throttle is located at a maximum throttle angle, and a fifth edge of the throttle grip has not yet entered into the locking recess of the fast idle handle.

8. The throttle and choke control linkage mechanism of carburetor of claim 6, wherein the choke shaft penetrates through the first through hole of the fast idle handle, and the fast idle handle freely rotate about the choke shaft.

9. The throttle and choke control linkage mechanism of carburetor of claim 8, wherein a choke shaft sleeve is disposed on a bottom side of the fast idle handle and sleeved around the choke shaft.

10. The throttle and choke control linkage mechanism of carburetor of claim 2, wherein the choke handle comprises a third surface, when the choke handle is rotated to enable the fast idle handle to rotate, the third surface touches a third peak of the throttle grip, a part of a fifth edge of the throttle grip contacts a ninth edge of the fast idle handle and is not located in the locking recess.

11. The throttle and choke control linkage mechanism of carburetor of claim 6, wherein the throttle grip is provided with a first linkage shaft configured for engaging the fast idle handle, when the fast idle handle rotates and the first peak contacts the first linkage shaft, the throttle is rotated to a maximum throttle angle by the throttle grip.

12. The throttle and choke control linkage mechanism of carburetor of claim 11, wherein the throttle grip is further provided with a second linkage shaft configured for engaging the choke handle, when the choke handle rotates until the second linkage shaft touch a first surface of the choke handle, the first linkage shaft contacts a ninth edge of the fast idle handle, but not in contact with the locking recess.

13. The throttle and choke control linkage mechanism of carburetor of claim 12, wherein the first surface is further provided with a concave portion, the concave portion is configured for linking with the throttle grip, when the choke handle rotate until the second linkage shaft is completely engaged with the concave portion, the choke valve is at the fully closed position and the throttle is opened with an angle larger than the idling position.

* * * * *